US008537081B2

(12) United States Patent
Awakura et al.

(10) Patent No.: US 8,537,081 B2
(45) Date of Patent: Sep. 17, 2013

(54) DISPLAY APPARATUS AND DISPLAY CONTROL METHOD

(75) Inventors: Hiroki Awakura, Yokohama (JP); Naruhiko Kasai, Yokohama (JP); Tsutomu Furuhashi, Yokohama (JP); Toshihiro Satou, Mobara (JP)

(73) Assignees: Hitachi Displays, Ltd., Chiba-Ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 1735 days.

(21) Appl. No.: 10/663,657

(22) Filed: Sep. 17, 2003

(65) Prior Publication Data

US 2005/0068270 A1 Mar. 31, 2005

(51) Int. Cl.
*G09G 3/30* (2006.01)

(52) U.S. Cl.
USPC ..... 345/78; 345/208

(58) Field of Classification Search
USPC ..... 345/77–87, 211–212, 208
See application file for complete search history.

(56) References Cited

U.S. PATENT DOCUMENTS

| | | | | |
|---|---|---|---|---|
| 5,990,629 | A * | 11/1999 | Yamada et al. | 315/169.3 |
| 6,243,061 | B1 * | 6/2001 | Sandoe et al. | 345/91 |
| 6,291,942 | B1 | 9/2001 | Odagiri et al. | 315/169.3 |
| 6,414,443 | B2 * | 7/2002 | Tsuruoka et al. | 315/169.3 |
| 6,501,227 | B1 | 12/2002 | Koyama | |
| 6,518,962 | B2 * | 2/2003 | Kimura et al. | 345/211 |
| 7,274,363 | B2 * | 9/2007 | Ishizuka et al. | 345/211 |
| 2002/0030647 | A1 * | 3/2002 | Hack et al. | 345/82 |
| 2002/0050962 | A1 * | 5/2002 | Kasai | 345/76 |

FOREIGN PATENT DOCUMENTS

| | | |
|---|---|---|
| JP | 1-284894 | 11/1989 |
| JP | 4-328791 | 11/1992 |
| JP | 7-507403 | 8/1995 |
| JP | 10-232649 | 9/1998 |
| JP | 2000-187467 | 7/2000 |
| JP | 2000-221945 | 8/2000 |
| JP | 2000-235370 | 8/2000 |
| JP | 2000-330517 | 11/2000 |
| JP | 2001-159878 | 6/2001 |
| KR | 10-0296872 | 5/2001 |
| WO | WO 93/24921 | 12/1993 |

* cited by examiner

*Primary Examiner* — Seokyun Moon
(74) *Attorney, Agent, or Firm* — Antonelli, Terry, Stout & Kraus, LLP.

(57) ABSTRACT

The present invention comprises: a display unit having a plurality of pixels arranged therein, each pixel including an organic EL element 24, a switching TFT, and a drive TFT; a data signal drive circuit for receiving image data for each frame period and outputting an image signal based on the image data; a scanning signal drive circuit for outputting a scanning signal for controlling a timing at which the switching element of each of the plurality of pixels receives the image signal; and a current source (a light emission power supply unit and a cathode potential control circuit together) for outputting a current supplied to the light emitting unit of each of the plurality of pixels through its drive element; wherein the current source modulates the value of the output current within each frame period.

10 Claims, 25 Drawing Sheets

FIG.18

| DATA SIGNAL VOLTAGE | PIXEL LIGHT EMISSION TIME PERIOD |
|---|---|
| $V_{63}$ | $T_{63}$ |
| $V_{62}$ | $T_{62}$ |
| ⋮ | ⋮ |
| $V_2$ | $T_2$ |
| $V_1$ | $T_1$ |
| $V_0$ | $T_0$ |

$$V_0 \leqq V_1 \leqq V_2 \leqq \cdots \leqq V_{62} \leqq V_{63}$$

$$T_0 \leqq T_1 \leqq T_2 \leqq \cdots \leqq T_{62} \leqq T_{63} \leqq 1\text{frame}$$

DISPLAY APPARATUS AND DISPLAY CONTROL METHOD

BACKGROUND OF THE INVENTION

The present invention relates to a display apparatus employing EL (Electro Luminescence) elements, organic EL elements, or other light-emitting type display elements (light-emitting elements), and a drive method therefor.

Light-emitting (or self-luminous) elements have the characteristic that the luminance of light emitted from them is proportional to the amount of current flowing through them, making it possible to provide a gray scale display by controlling the amount of current flowing in the elements. A plurality of such light-emitting elements may be arranged so as to form a display apparatus.

Displays using active matrix light-emitting elements are advantageous over those using simple matrix light-emitting elements in the luminance of the screen and power consumption. Each pixel of a display using active matrix light-emitting elements, however, requires a TFT (Thin Film Transistor) element capable of performing accurate V-I conversion from signal (voltage) level variations to current variations.

One method for providing a gray scale display without using such TFT elements, disclosed in JP-A-2000-235370, is to set a gray scale level for each pixel using pulse width modulation according to an input signal during each frame period.

Another problem with displays using light-emitting elements arises when the light-emitting elements are used for a long period of time. Light-emitting elements degrade over time, leading to a reduction in the luminance of their light. U.S. Pat. No. 6,291,942 (JP-A-2001-13903) discloses a technique for compensating for variations in the luminance of a light-emitting element due to its degradation over time.

JP-A-2000-330517 discloses a technique for causing an organic EL to emit light at a predetermined luminance level on average. This technique measures the magnitude of the current flowing in the organic EL to measure the amount of charge injected into it, and controls this amount by cutting off the supply of the gate voltage to the drive transistor when the total amount of the charge has reached a predetermined value.

JP-A-2000-221945 discloses a technique for increasing the number of gray scale levels which can be displayed without increasing the number of the data bits. This technique controls the voltage applied to the panel based on an average of the luminance levels of the video signals for each field such that, for example, the peak luminance level is increased when the average luminance level is low and the peak luminance level is decreased when the average luminance level is high.

The technique disclosed in the above U.S. Pat. No. 6,291,942 (JP-A-2001-13903), however, only compensates for a reduction in the luminance of light emitted from a degraded light-emitting element by changing the voltage applied to the element or adjusting the signal pulse width in order to cause the element to emit light at a proper luminance level. Therefore, this technique in no way delays degradation of the light-emitting element itself.

The techniques disclosed in the above JP-A-2000-235370, JP-A-2000-330517, and JP-A-2000-221945 also do not delay degradation of light-emitting elements.

A light-emitting element degrades more quickly with increasing current density of the element, that is, increasing luminance of light emitted from it. However, simply decreasing the display luminance of light-emitting elements to delay their degradation lowers the display quality of the display apparatus. Light-emitting elements have the property that their voltage-current density characteristic changes with temperature. Since the luminance of light emitted from a light-emitting element is proportional to the amount of current flowing in the element, as described above, the luminance of light emitted from the light-emitting element changes with temperature. This means that the luminance of light emitted from a light-emitting element may excessively increase due to temperature variation, which may accelerate the degradation. Conversely, if the luminance of light emitted from the light-emitting element is reduced due to temperature variation, the image quality will be deteriorated.

The present invention is intended to provide a display apparatus and method for increasing peak luminance of a display having a high gray scale level (for example, white) while reducing a rise in the luminance of a display having a low gray scale level (for example, black).

SUMMARY OF THE INVENTION

An object of the present invention is to provide an apparatus and method for delaying degradation of display elements.

Another object of the present invention is to provide an apparatus and method for reducing changes in the luminance of light emitted from display elements due to temperature changes.

According to one aspect of the present invention, a display apparatus comprises: a pixel array formed as a result of arranging a plurality of pixels; a data signal drive circuit; a scanning signal drive circuit; and a current source; wherein a current supplied from the current source to the light-emitting unit of each of the plurality of pixels through its drive element is modulated within each frame period.

According to another aspect of the present invention, a display apparatus comprises: a pixel array including a plurality of display elements; a data signal drive circuit; a scanning signal drive circuit; and a power supply unit; wherein a relationship between a gray scale and luminance of each display element is controlled such that a gray scale level is set to a lower luminance level when an average luminance level for a predetermined display period is high than when the average luminance level for the predetermined display period is low.

The present invention can increase peak luminance of a display having a high gray scale level (for example, white) while reducing a rise in the luminance of a display having a low gray scale level (for example, black), making it possible to enhance the contrast and the image quality.

The present invention also can delay degradation of display elements.

The present invention also can reduce changes in the luminance of light emitted from display elements due to temperature changes.

BRIEF DESCRIPTION OF THE DRAWINGS

FIG. 18 shows an example of the relationship between the analog voltage input to the PWM circuit 25 shown in FIG. 16 and the light emission time period of an organic EL element 24.

DETAILED DESCRIPTION OF THE PREFERRED EMBODIMENTS OF THE PRESENT INVENTION

An image with many dark areas displayed on a display apparatus lacks strong visual impact, affecting the image quality, unless the peak luminance of the bright portions is enhanced. The display luminance of a displayed image with many bright areas, on the other hand, can be reduced since it does not affect the image quality very much. Therefore, the present invention includes means for detecting an average luminance level of the display screen and means for controlling the display luminance. The present invention controls the display luminance of the screen such that it is reduced when an image having a high average luminance level is displayed. Controlling the display luminance according to the average luminance level of the screen makes it possible to reduce the amount of light emitted from the light-emitting elements of the display apparatus without decreasing the display quality and thereby extend the life of the elements. In addition, the present invention provides display apparatuses having different configurations to produce the effects of reducing the power consumption, compensating for changes in the luminance of emitted light due to temperature changes, enhancing the display quality, compensating for color balance mismatches due to variations among the degradation rates of the colors, etc.

A first embodiment of the present invention will be described below in detail with reference to the accompanying drawings.

Based on the fact that the luminance of light emitted from a light-emitting element is proportional to the amount of current flowing through the element, the first embodiment of the present invention measures the total amount of current flowing in the light-emitting elements of a display apparatus to obtain average luminance information on its display screen. When the average luminance level is high, the voltage applied to the light-emitting elements is controlled so as to reduce the actual display luminance level of each element. Measuring the total amount of current flowing in the light-emitting elements of the display apparatus also makes it possible to reduce changes in the average luminance level of the display apparatus and in the luminance of light emitted from the light-emitting elements due to temperature changes.

Figure 1:
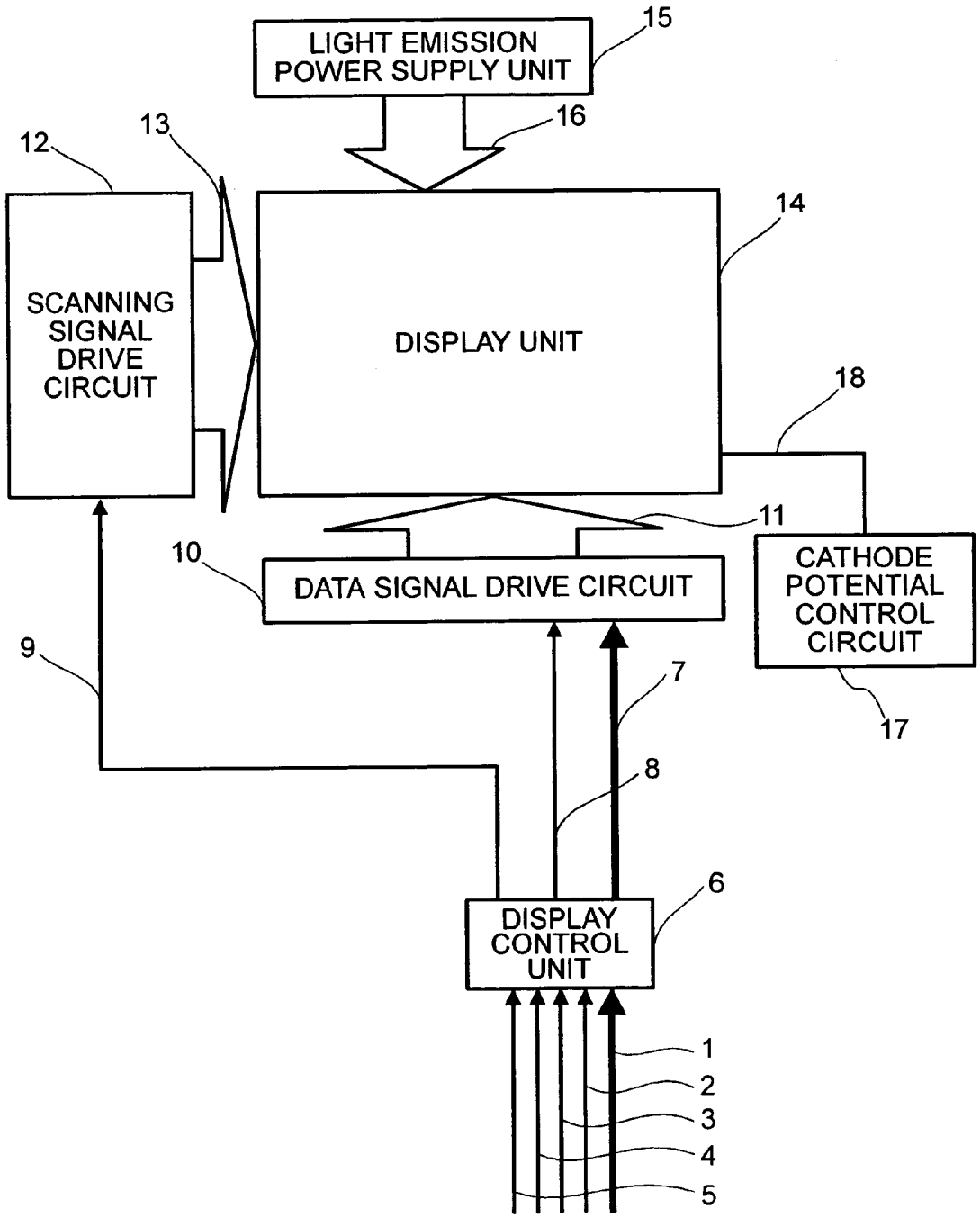
FIG. 1 shows an organic EL element display apparatus according to a first embodiment of the present invention.

FIG. 1 shows a light-emitting element display apparatus according to the first embodiment of the present invention. The following description assumes that the light-emitting elements are organic EL elements. Referring to the figure, reference numeral 1 denotes a digital display data signal (image signal); 2, a vertical sync signal (control signal); 3, a horizontal sync signal (control signal); 4, a data enable signal (control signal); and 5, a synchronous clock (control signal). All of these signals (1 to 5) are digital video signals input from outside. The vertical sync signal 2 has a period of one display screen (one frame) and indicates the start and end of each frame of the digital display data signal 1. The horizontal sync signal 3 has a period of one horizontal line and indicates the start and end of each horizontal line of the digital display data signal 1. The data enable signal 4 indicates a valid period for the digital display data signal 1. All of the signals 1 to 4 are entered in synchronization with the synchronous clock 5. The present embodiment assumes that the digital display data signal 1 is transferred in raster scan format as a series of pixels starting with the top left pixel for each screen (frame). Reference numeral 6 denotes a display control unit; 7, an analog display data signal; 8, a data signal drive circuit control signal; and 9, a scanning signal drive circuit control signal. The display control unit 6 converts the digital display data signal 1 into an analog signal having a predetermined voltage and outputs it as the analog display data signal 7. The display control unit 6 also outputs the data signal drive circuit control signal 8 and the scanning signal drive circuit control signal 9 according to the signals 1 to 5 entered from outside. Reference numeral 10 denotes a data signal drive circuit; 11, datalines; 12, a scanning signal drive circuit; 13, scanlines; and 14, a display unit. The data signal drive circuit 10 is controlled with the data signal drive circuit control signal 8 and writes the display data signal in the display unit 4 through the datalines 11. The scanning signal drive circuit 12 is controlled with the scanning signal drive circuit control signal 9 and sends a write selection signal to the display unit 14 through the scanlines 13. Reference numeral 15 denotes a light emission power supply unit, and 16 denotes light emission power supply lines. The light emission power supply unit 15 supplies to the display unit 14 through the light emission power supply lines 16 the power necessary for the organic EL elements to emit light. Reference numeral 17 denotes a cathode potential control circuit, and 18 denotes a cathode current line. The cathode potential control circuit 17 controls the cathode side potential of the organic EL elements within the display unit 14. The display unit 14 varies the luminous intensity of the internal organic EL elements according to the display data written by the data signal drive circuit 10 to display an image. The light emission power supply unit 15 preferably has functions to both produce power and control the current value of the power. The display unit 14 is a pixel array formed as a result of arranging a plurality of pixels in a matrix. It should be noted that the light emission power supply unit 15 may control the amount of current instead of the current value.

Figure 2:
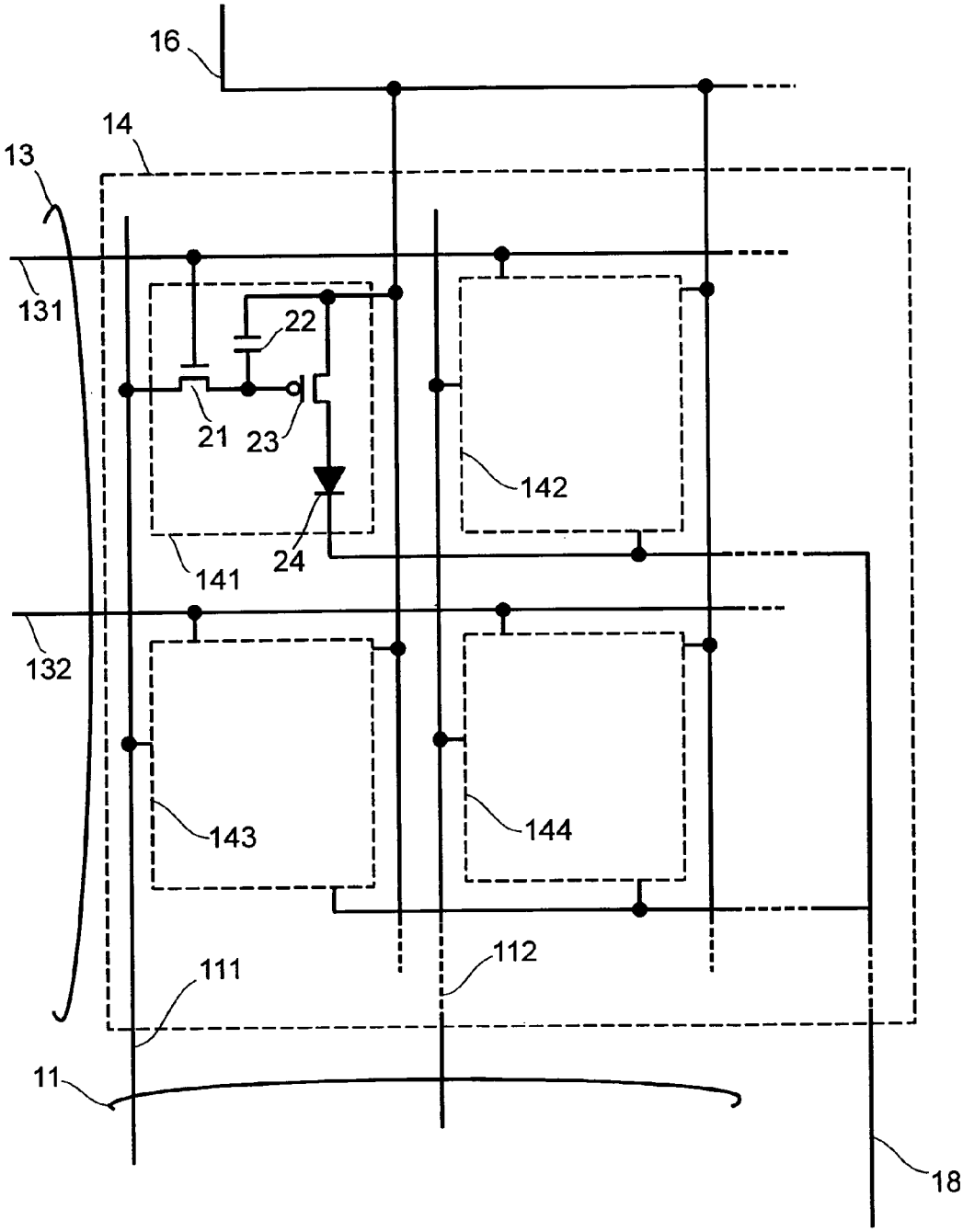
FIG. 2 shows an internal configuration example of the display unit 14 shown in FIG. 1.

FIG. 2 shows an internal configuration example of the display unit 14.

Referring to the figure, reference numeral 111 denotes a first dataline, and 112 denotes a second dataline. One end of each of these datalines is connected to the data signal drive circuit 10. Reference numeral 131 denotes a first scanline, and 132 denotes a second scanline. One end of each of these scanlines is connected to the scanning signal drive circuit 12. FIG. 2 only shows the internal configuration of a first-row first-column pixel 141. However, a first-row second-column pixel 142, a second-row first-column 143, and a second-row second-column 144 also have the same internal configuration. Reference numeral 21 denotes a switching TFT; 22, a data storage capacitance; 23, a drive TFT; and 24, an organic EL element. The gate of the switching TFT 21 is connected to the first scanline 131, while its drain is connected to the first dataline 111. When the scanning signal drive circuit 12 has output a selection signal onto the first scanline, the switching TFT 21 turns on. As a result, the analog display data signal voltage output from the data signal drive circuit 10 to the first dataline 111 is stored (charged) on the data storage capacitance 22. The data storage capacitance 22 continues to hold the display data signal even after the scanning signal drive circuit 12 turns off the switching TFT 21. The amount of current flowing between the source and the drain of the drive TFT 23 changes with voltage stored (charged) on the data storage capacitance 22. By using this characteristic, the amount of current flowing in the organic EL element 24 is controlled to adjust the luminance of light emitted from the element. The cathode of the organic EL element 24 is connected to the cathode potential control circuit 17 through the cathode current line 18.

Figure 3:
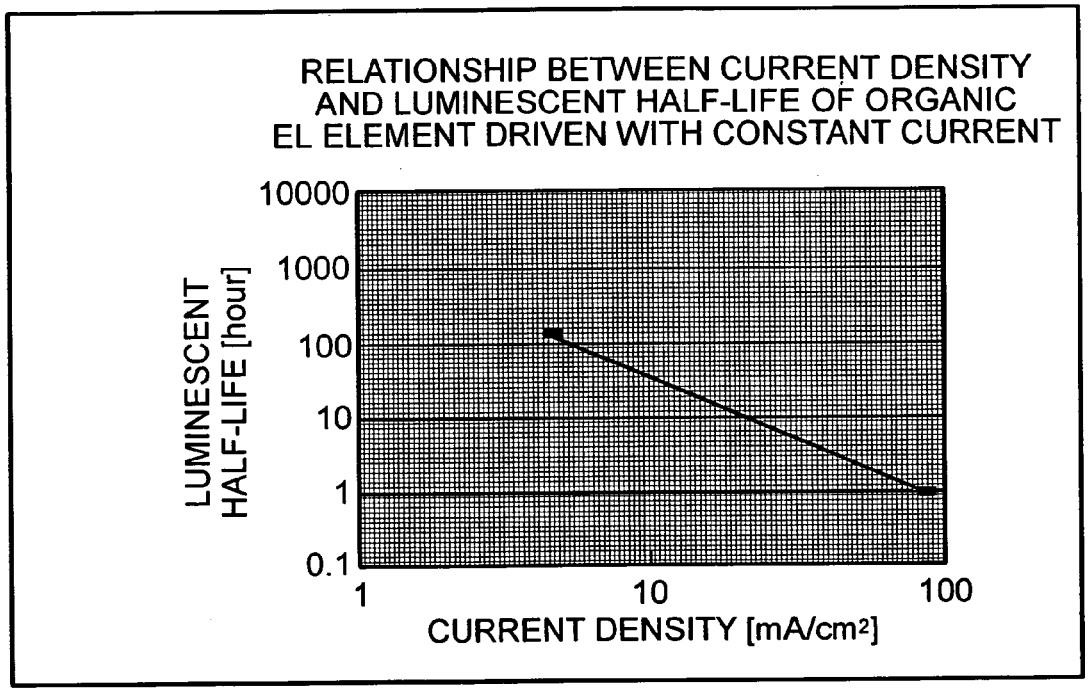
FIG. 3 is a diagram showing the relationship between the density of current flowing in an organic EL element and the time taken for the luminance of light emitted from the element to be reduced by half due to degradation when the current in the organic EL element is maintained at a constant value.

FIG. 3 is a diagram showing the relationship between the density of current flowing in the organic EL element and the luminescent half-life of the element when the organic EL element continues to be caused to emit light while maintaining the current at a constant value. The luminescent half-life is inversely proportional to the current density. The luminance of light emitted from the organic EL element is proportional to the current density (current per unit surface area) of the element. FIG. 3 indicates that when the current density of the organic EL element is high, that is, the luminance of light emitted from the element is high, the organic EL element degrades more quickly than when the luminance is low.

Figure 4:
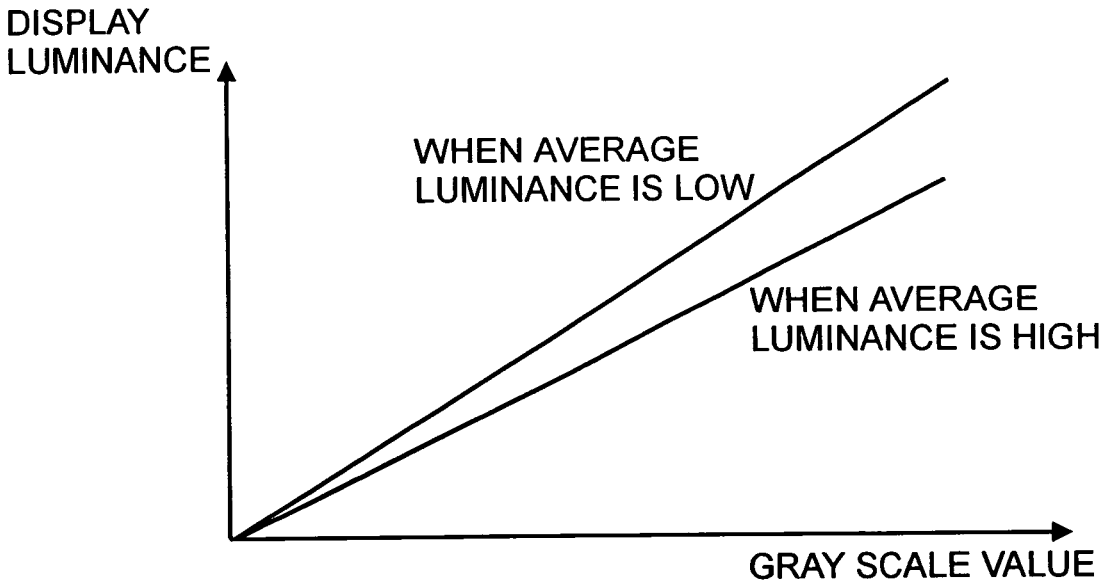
FIG. 4 is a graph showing the relationships between the gray scale value and the actual display luminance level when an average luminance level of the screen display is high and low.

FIG. 4 shows an example of how to control the display luminance of a display apparatus according to the present invention. Specifically, this figure indicates the relationships between the display gray scale signal (value) entered from outside to the display apparatus and the actual display luminance level when an average luminance level of the display screen of the display apparatus is high and low. Each gray scale value is set to a higher display luminance level when the average luminance level is low than when the average luminance level is high. That is, when the average luminance level is low, the luminance characteristic curve has a steeper slope than when the average luminance level is high. The present invention controls the actual display luminance such that its level is a little lower than an indicated (ordinary) level when the average luminance level of the display screen of the display apparatus is high. According to the present invention, an average of the luminance levels of the pixels constituting one screen (one frame) is used as the average luminance level. However, it is possible to use an average of the luminance levels of the pixels constituting a plurality of screens or a portion of a screen (for example, pixels constituting a few lines on the screen) as the average luminance level.

Figure 5:
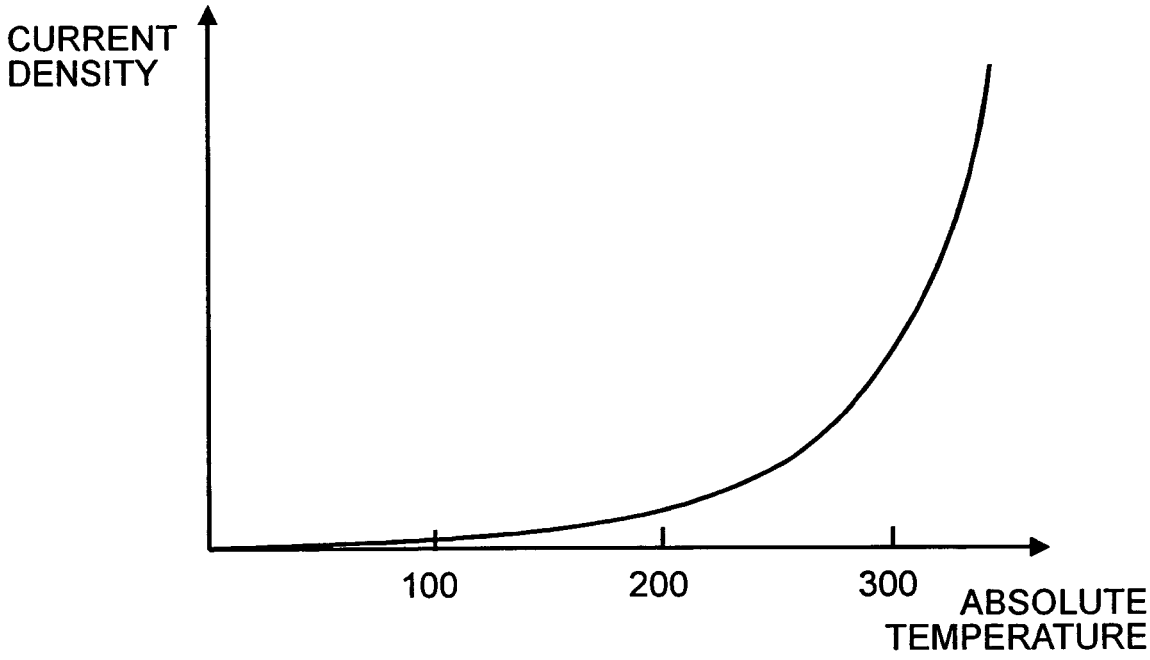
FIG. 5 is a graph showing the temperature-current density characteristic of a light-emitting element when it is driven with a constant voltage.

FIG. 5 is a graph showing the temperature-current density characteristic of an organic EL element when a constant voltage is applied between both electrodes of the element and the temperature is varied. Inspection of the graph reveals that the current density rapidly increases around room temperature. Since the luminance of light emitted from an organic EL element is proportional to its current density, the luminance largely changes due to temperature changes around room temperature.

Figure 6:
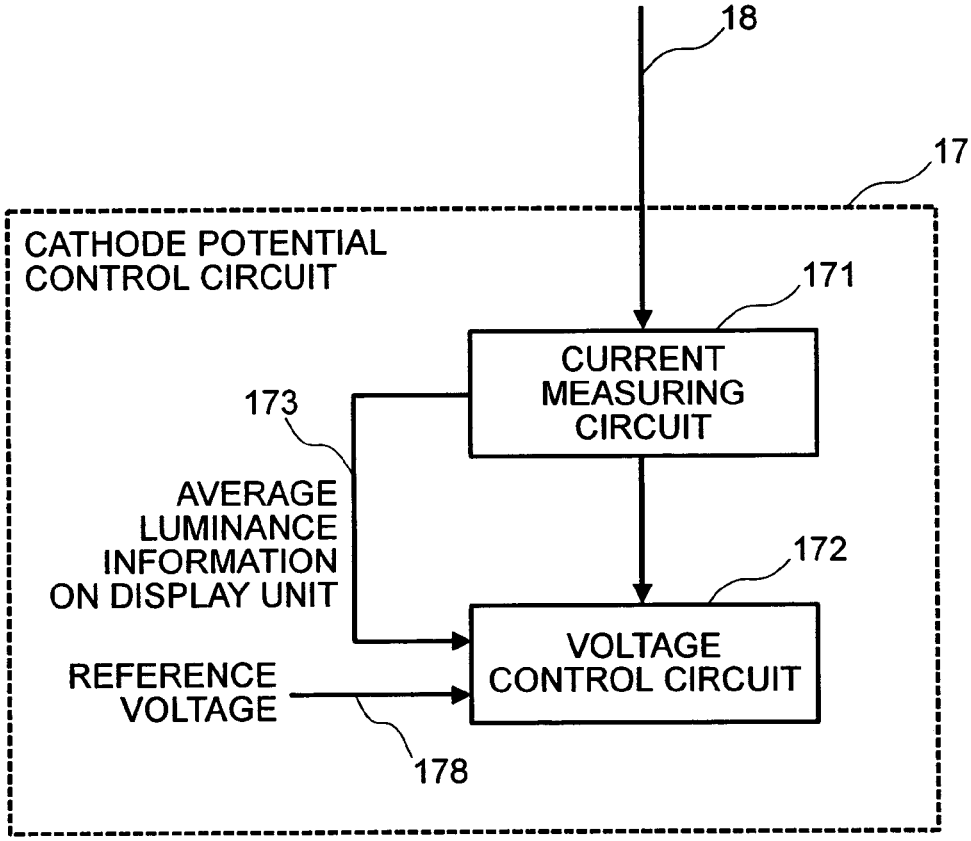
FIG. 6 is a schematic diagram showing the internal configuration of the cathode potential control circuit 17 shown in FIG. 1.

FIG. 6 shows the configuration of the cathode potential control circuit 17, which measures the average luminance level of the screen of the display apparatus and controls the luminance of emitted light based on the measurement results. Reference numeral 171 denotes a current measuring circuit; 172, a voltage control circuit; 173, average luminance information on the display unit 14; and 178, a reference voltage of the voltage control circuit 172. The current measuring circuit 171 measures the current flowing from the cathode current line 18 to the cathode potential control circuit 17. The average luminance information 173 on the display unit is obtained from the value of the current. The voltage control circuit 172 is controlled based on the average luminance information 173 and the reference voltage 178 to change the cathode side potential of the organic EL element 24 shown in FIG. 2.

Figure 7:
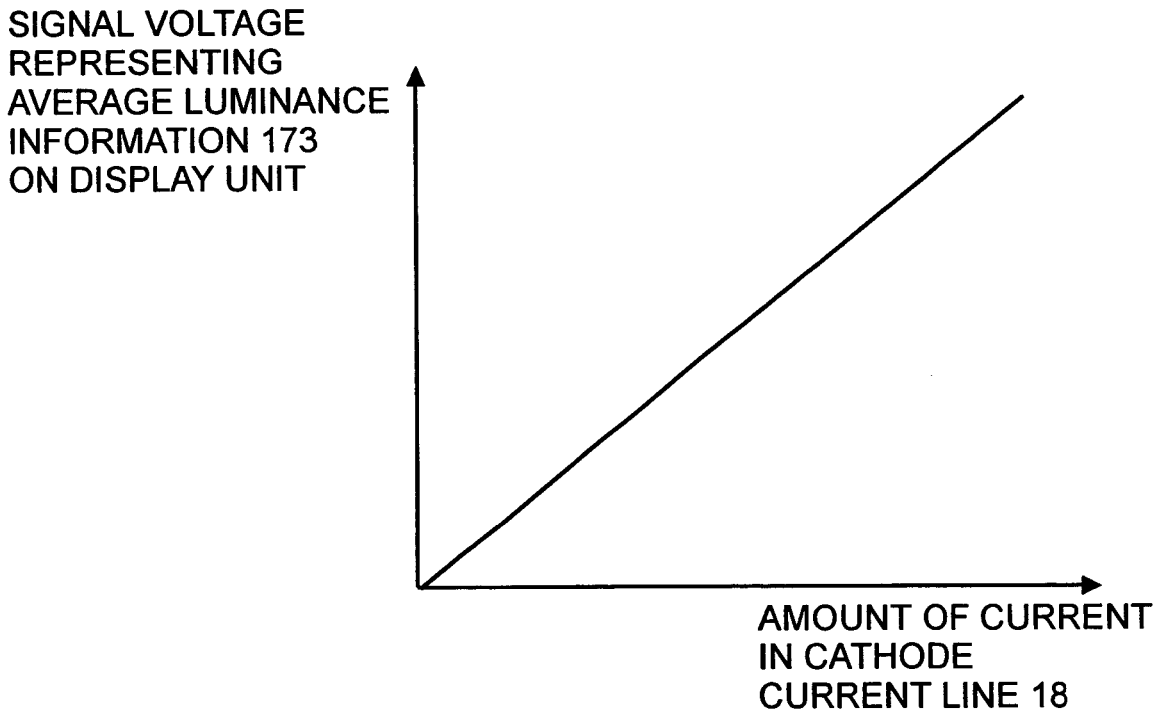
FIG. 7 shows an example of the relationship between the current flowing through the cathode current line 18 shown in FIG. 1 and the analog voltage signal output by the current measuring circuit 171 shown in FIG. 6 as average luminance information 173 on the display unit.

FIG. 7 is a diagram showing the operation of the current measuring circuit 171. The current measuring circuit 171 measures the amount of current flowing from the cathode current line 18 to the cathode potential control circuit 17 and outputs a voltage signal according to the measured amount as the average luminance information 173 on the display unit. The signal voltage representing the average luminance information 173 is substantially proportional to the amount of current in the cathode current line 18. Thus, FIG. 7 is a graph showing the relationship between the amount of current flowing from the cathode current line 18 to the cathode potential control circuit 17 and the signal voltage output as the average luminance information 173 on the display unit.

Figure 8:
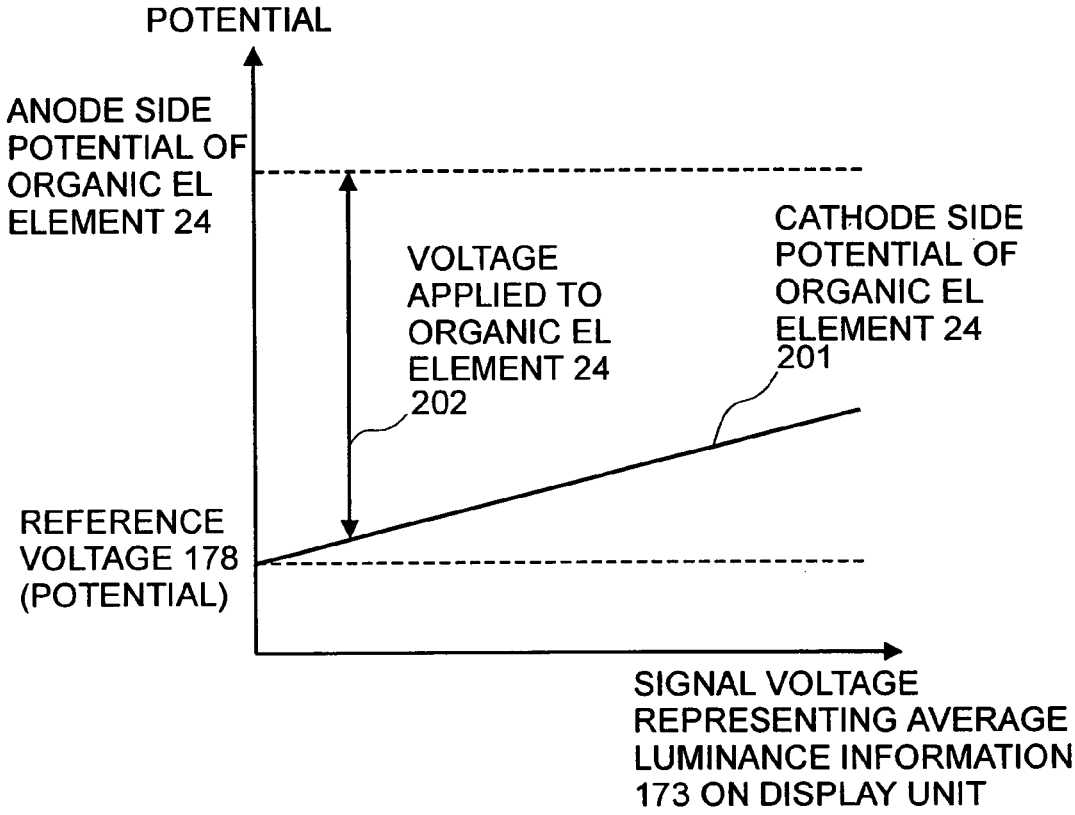
FIG. 8 conceptually shows how the voltage applied to an organic EL element 24 changes as its cathode potential changes according to the average luminance information 173.

FIG. 8 is a diagram showing the operation of the voltage control circuit 172. Reference numeral 201 denotes the cathode side potential of the organic EL element 24, and 202 denotes the voltage applied to the organic EL element. The figure indicates that as the signal voltage representing the average luminance information 173 on the display unit 14 increases, so does the output potential of the cathode potential control circuit 17, that is, the cathode side potential of the organic EL element 24, and as a result, the voltage 202 applied to the organic EL element decreases.

Figure 9:
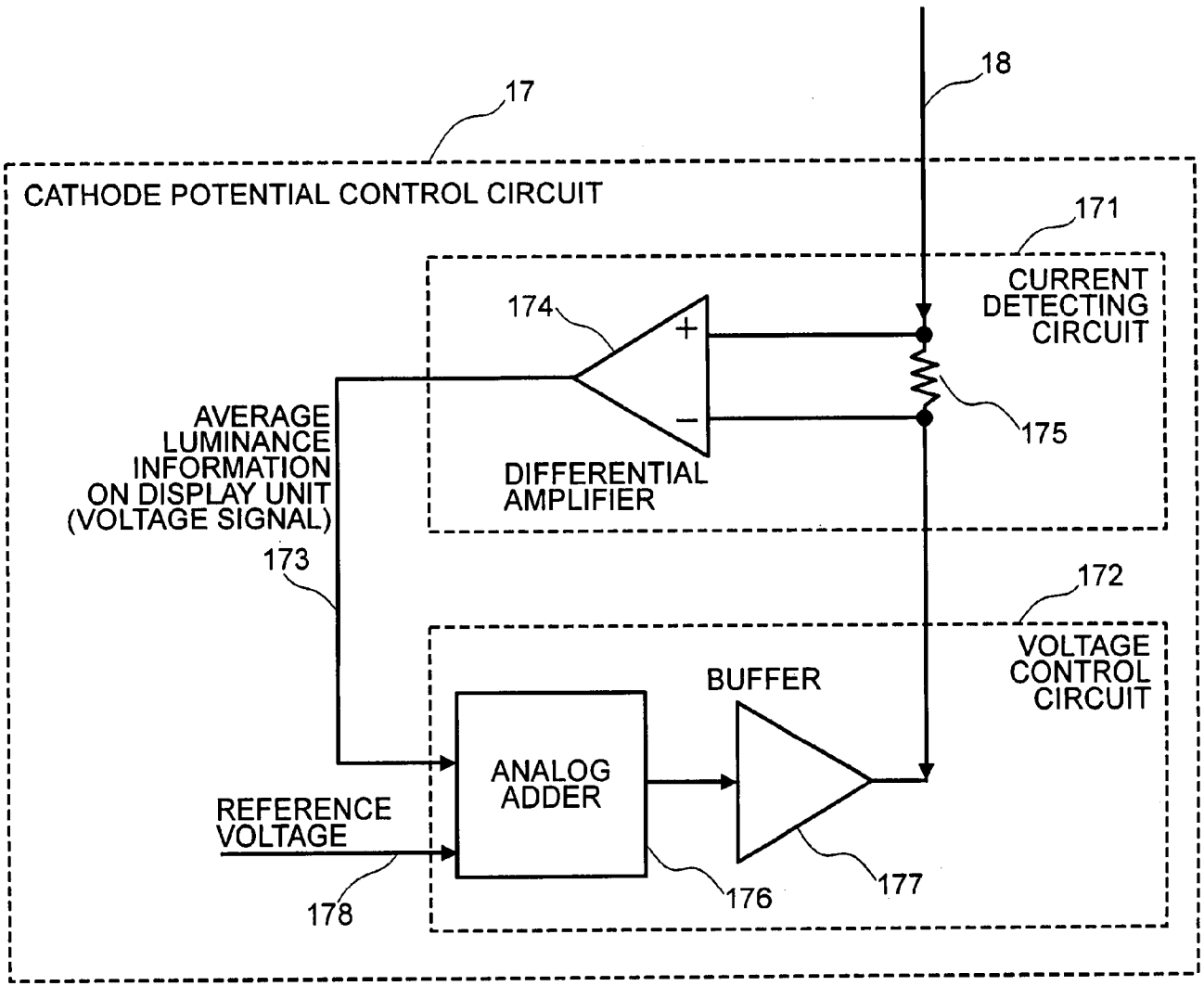
FIG. 9 shows an internal configuration example of the cathode potential control circuit 17 shown in FIG. 1.

FIG. 9 is a diagram showing the configuration of the cathode potential control circuit 17 shown in FIG. 6 according to the present invention. Reference numeral 174 denotes a differential amplifier; 175, a resistance; 176, an analog adder; 177, a buffer; and 178, a reference voltage. In the current detecting circuit 171, a voltage is generated across the resistance 175 due to the cathode current flowing through it. The differential amplifier 174 amplifies the generated voltage with a given gain and outputs an analog signal representing the average luminance information 173 on the display unit. The analog adder 176 outputs the sum of the signal voltage representing the average luminance information 173 on the display unit and the reference voltage 178 as a voltage signal. The buffer 177 is provided to enhance the output current capacity of the cathode potential control circuit, and its output voltage is set equal to that of the analog adder 176.

Description will be made below of a method for controlling the display luminance according to the present embodiment with reference to FIGS. 1 to 9.

First of all, how to control the display luminance of each pixel in the display unit will be described with reference to FIGS. 1 and 2. The display control unit 6 first receives the digital display data signal 1, the vertical sync signal 2, the horizontal sync signal 3, the data enable signal 4, and the synchronous clock 5 all entered from outside of the display apparatus. Based on the vertical sync signal 2, the horizontal sync signal 3, the data enable signal 4, and the synchronous clock 5, the display control unit 6 outputs the scanning signal drive circuit control signal 9 and the data signal drive circuit control signal 8 to the scanning signal drive circuit 12 and the data signal drive circuit 10, respectively, at a predetermined timing. The display control unit 6 also converts the digital display data signal 1 into an analog voltage signal whose amplitude is within a predetermined voltage range, and outputs it to the data signal drive circuit 10 as the analog display data signal 7. The scanning signal drive circuit 12 receives the scanning signal drive circuit control signal 9 and outputs a selection signal to the scanlines 13. The selection signal is a voltage signal for turning on the switching TFT 21 of each pixel in the display unit 14. The selection signal is output to each scanline sequentially, starting with the uppermost line on the display unit. Therefore, only the switching TFT 21 of each pixel on the scanline to which the selection signal has been output is turned on, making it possible to write a display signal to the storage capacitance 22 of the pixel through the dataline 11. The data signal drive circuit 10, on the other hand, outputs the analog display data signal 7 to the datalines 11. The analog display data signal 7 is output to each dataline sequentially, starting with the leftmost dataline on the display unit 14. Thus, the analog display data signal 7, which is an analog voltage signal, is written to the data storage capacitance 22 of the pixel at the intersection point of the scanline to which the selection signal has been output and the dataline to which the analog display data signal has been output. It should be noted that the present embodiment employs a "point sequential writing" system in which the pixel display data is written one pixel at a time. However, a "line sequential writing" system may be used in which the data signal drive circuit 10 latches one horizontal line of display data on the display unit at a time and sequentially writes each line of display data. It should be further noted that according to the present embodiment, the display control unit 6 converts the digital video data signal entered from outside of the display apparatus into an analog voltage signal. However, the data signal drive circuit 10 may convert the digital signal into the analog signal.

As described above in reference to FIG. 3, an organic EL element degrades more quickly when the luminance of light emitted from the element is high than when the luminance is low. Therefore, reduction of the display luminance is effective in delaying the degradation. However, simply reducing the display luminance may affect the display quality. To overcome this problem, the following arrangement may be made. When the screen is bright as a whole displaying, for example, an image with many white portions, the display luminance of the entire screen can be reduced since it does not affect the image quality very much. When the screen is dark as a whole displaying, for example, an image with many black portions, however, reducing the display luminance of the bright portions affects the display quality. Therefore, as shown in FIG. 4, the display apparatus may be controlled such that the display luminance is reduced when an average display luminance level of the screen is high in order to reduce degradation of the organic EL elements while maintaining the display quality. It should be noted that the display luminance may be increased when the average display luminance level of the screen is low.

As shown in FIG. 5, the current density of an organic EL element increases with increasing temperature. Accordingly, the luminance of light emitted from the element also increases with increasing temperature. However, use of the above control method produces the effect of reducing the display luminance also when the average luminance level of the screen of the display apparatus increases due to temperature increase. Therefore, the above control method is also an effective way of reducing changes in the display luminance due to changes in the temperature of the organic EL elements.

Description will be made below of means for implementing the above control method for reducing degradation of organic EL elements. Implementation of the above control method requires a means for measuring an average luminance level of the screen display of a display apparatus, and a means for controlling the display luminance of the display apparatus. One example method is described below in which the cathode potential control circuit 17 measures the sum of the currents flowing in all organic EL elements of the screen of the display apparatus to obtain the average luminance information on the display unit 14, and controls the cathode side potential of the organic EL elements 24 based on the obtained information to control the display luminance of the display apparatus. FIG. 6 shows an configuration example of the cathode potential control circuit 17 for implementing this method. The luminance of light emitted from an organic EL element is proportional to the amount of current flowing through the element. Therefore, it is possible to estimate an average luminance level of the screen of the display apparatus from the sum of the amounts of currents flowing in all organic EL elements of the screen of the display apparatus. To do this, the current measuring circuit 171 provided within the cathode potential control circuit 17 measures the (total) current flowing from the cathodes of the organic EL elements 24 in the display apparatus to the cathode potential control circuit 17 through the cathode current line 18. The average luminance information 173 on the display unit is obtained from the amount of this current. The average luminance information on the display unit is represented by an analog voltage signal proportional to the amount of current flowing in the cathode current line 18 as shown in FIG. 7. The voltage control circuit 172 is controlled based on the average luminance information 173 to control the cathode side potential of each organic EL element 24 as shown in FIG. 8. By controlling the cathode side potential of the organic EL element 24 as shown in FIG. 8, a voltage 202 applied to the organic EL element 24 can be decreased when the average luminance level of the display unit 14 is high, and the voltage 202 can be increased when the average luminance level is low. Thus, it is possible to control the display luminance according to the average luminance level of the display unit as shown in FIG. 4.

FIG. 9 shows a circuit configuration example of the cathode potential control circuit 17 for implementing the above control method. Referring to FIGS. 1 and 9, assume, for example, that the voltage of the light emission power supply unit 15 is set to 15 V; the reference voltage 178 of the cathode potential control circuit 17, 0 V; the resistance value of the resistance 175 of the current detecting circuit, 1Ω; and the gain of the differential amplifier 174, 100. When the current flowing in the cathode current line 18 is 10 mA, a voltage of 10 mV is generated across the resistance 175. The differential amplifier amplifies this voltage to produce a voltage of 1 V representing the average luminance information 173 on the display unit. The analog adder 176 outputs the sum of the voltage representing the average luminance information 173 on the display unit and the reference voltage 178, that is, a voltage of 1 V. Accordingly, the output voltage of the cathode potential control circuit 17 is 1 V, ignoring the voltage across the resistance 175 since it is small. Therefore, when the current flowing in the cathode current line 18 is 10 mA, the potential difference between the light emission power supply unit 15 and the cathode potential control circuit 17 is 14 V. When, on the other hand, the average luminance level of the display unit 14 is 3 times as high as that in the above example, that is, when the current flowing in the cathode current line 18 is 30 mA, the output voltage of the cathode potential control circuit 17 is 3 V (similarly calculated as in the above example). When the current flowing in the cathode current line 18 is 30 mA, the potential difference between the light emission power supply unit 15 and the cathode potential control circuit 17 is 12 V. As in the above examples, the circuit configuration shown in FIG. 6 allows controlling the potential difference between the light emission power supply unit 15 and the cathode potential control circuit 17 according to the average luminance level of the display unit 14, making it possible to decrease the voltage applied to the organic EL elements 24 with increasing average luminance level and thereby reduce the luminance of the emitted light.

According to the above embodiment, the cathode potential control circuit 17 is provided with the means for measuring the total current passing through the organic EL elements 24 in the display unit 14 to obtain the average luminance level of the display unit and the means for controlling the voltage applied to the organic EL elements according to the average luminance level of the display unit. However, both means may be provided in the light emission power supply unit 15. Further, the average luminance level measuring means may be provided in the cathode potential control circuit 17 and the means for controlling the voltage applied to the organic EL elements according to the average luminance level of the display unit may be provided in the light emission power supply unit 15, or vice versa.

Further, in the above embodiment, the maximum display value and the minimum display value of the digital display data signal 1 input to the display control unit 6 may be monitored, and when the difference between these values is small, the display luminance may be reduced even if the average luminance level is not so high.

A second embodiment of the present invention will be described in detail with reference to accompanying drawings.

The second embodiment of the present invention controls the output signal voltage of a signal line driving means according to average luminance information to control the display luminance of the screen.

Figure 10:
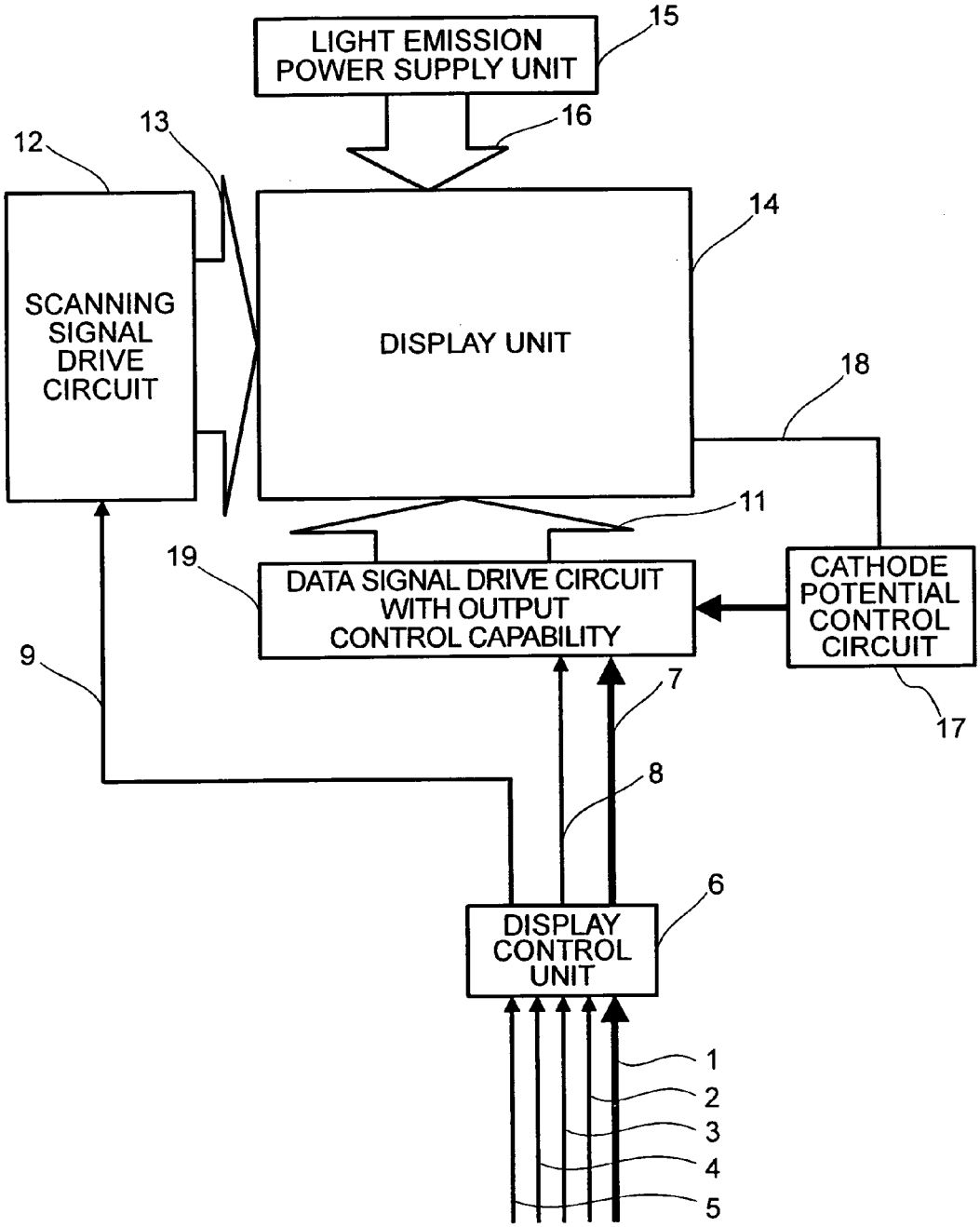
FIG. 10 shows an organic EL element display apparatus according to a second embodiment of the present invention.

FIG. 10 shows a configuration example of an organic EL element display apparatus according to the second embodiment of the present invention. Most of the components are the same as those used by the first embodiment of the present invention shown in FIG. 1. Each component in FIG. 10 operates in the same way as the corresponding component in FIG. 1. However, the second embodiment newly employs a data signal drive circuit with output control capability 19, instead of the data signal drive circuit 10 of the first embodiment. The data signal drive circuit with output control capability 19 converts the analog display data signal 7 according to the average luminance information 173 obtained by the cathode potential control circuit 17 and outputs it to the datalines 11. The following description assumes that the average luminance information 173 is represented by an analog voltage signal whose amplitude is proportional to the average luminance level of the display unit 14.

Figure 11:
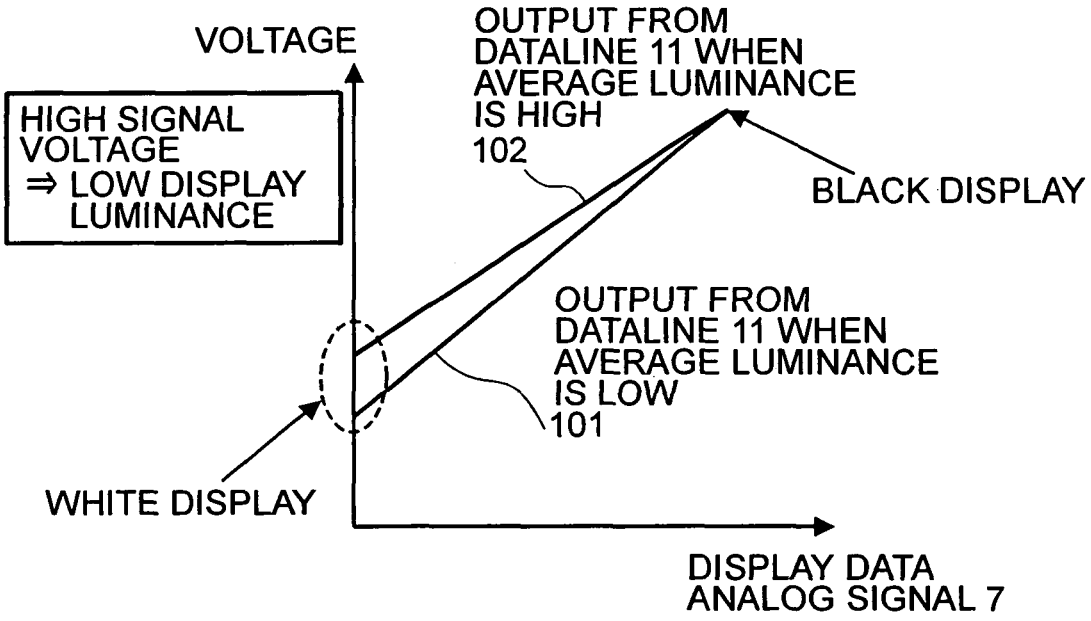
FIG. 11 is a graph showing the relationships between the display data input to the data signal drive circuit 19 shown in FIG. 10 and the display data (signal) output from the circuit when an average luminance level of the display unit is high and low.

FIG. 11 shows the relationship between the input and the output of the data signal drive circuit with output control capability 19 in an arrangement in which the data signal drive circuit with output control capability 19 is provided with an analog amplification circuit and amplifies the analog display data signal 7 according to the average luminance information 173 and outputs the amplified signal to the datalines 11. Reference numeral 101 denotes a graph obtained when the average luminance level of the display unit 14 is low, while 102 denotes a graph obtained when the average luminance level of the display unit 14 is high. As the average luminance level increases, the analog display data signal is amplified to a higher voltage which is output to the datalines 11. In FIG. 2, the drive TFT 23 of the pixel circuit is a P-MOS. Therefore, as the gate potential of the drive TFT 23 increases, the amount of current flowing between its source and drain decreases and hence the luminance of light emitted from the organic EL element 24 decreases. Accordingly, the above configuration of the data signal drive circuit with output control capability 19 allows controlling the display luminance such that it is decreased with increasing average luminance level of the display unit 14.

It should be noted that even though the means for controlling the display luminance according to the average luminance information on the display unit 14 is provided in the data signal drive circuit with output control capability 19 in the above arrangement, it may be provided in the display control unit 6 instead to implement the above control method.

A third embodiment of the present invention will be described in detail with reference to accompanying drawings.

The third embodiment of the present invention controls the display luminance of the screen by performing digital signal processing on the display data signal entered from outside according to average luminance information and thereby converting the display data.

Figure 12:
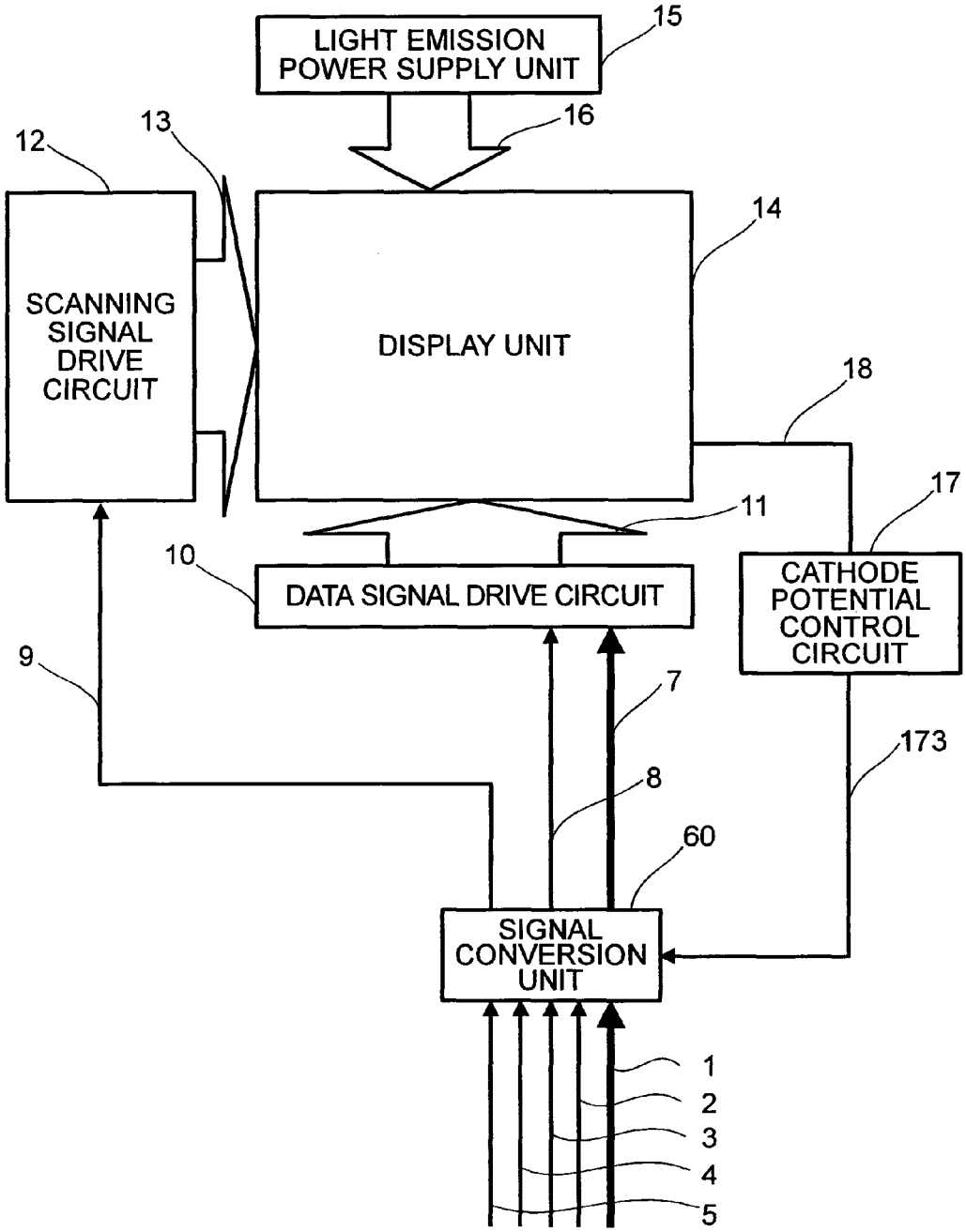
FIG. 12 shows an organic EL element display apparatus according to a third embodiment of the present invention.

FIG. 12 shows a configuration example of an organic EL element display apparatus according to the third embodiment of the present invention. Most of the components are the same as those used by the first embodiment of the present invention shown in FIG. 1. Each component in FIG. 12 operates in the same way as the corresponding component in FIG. 1. However, the third embodiment newly employs a signal conversion unit 60, instead of the display control unit 6. The signal conversion unit 60 has the following functions in addition to those of the display control unit 6.

Figure 13:
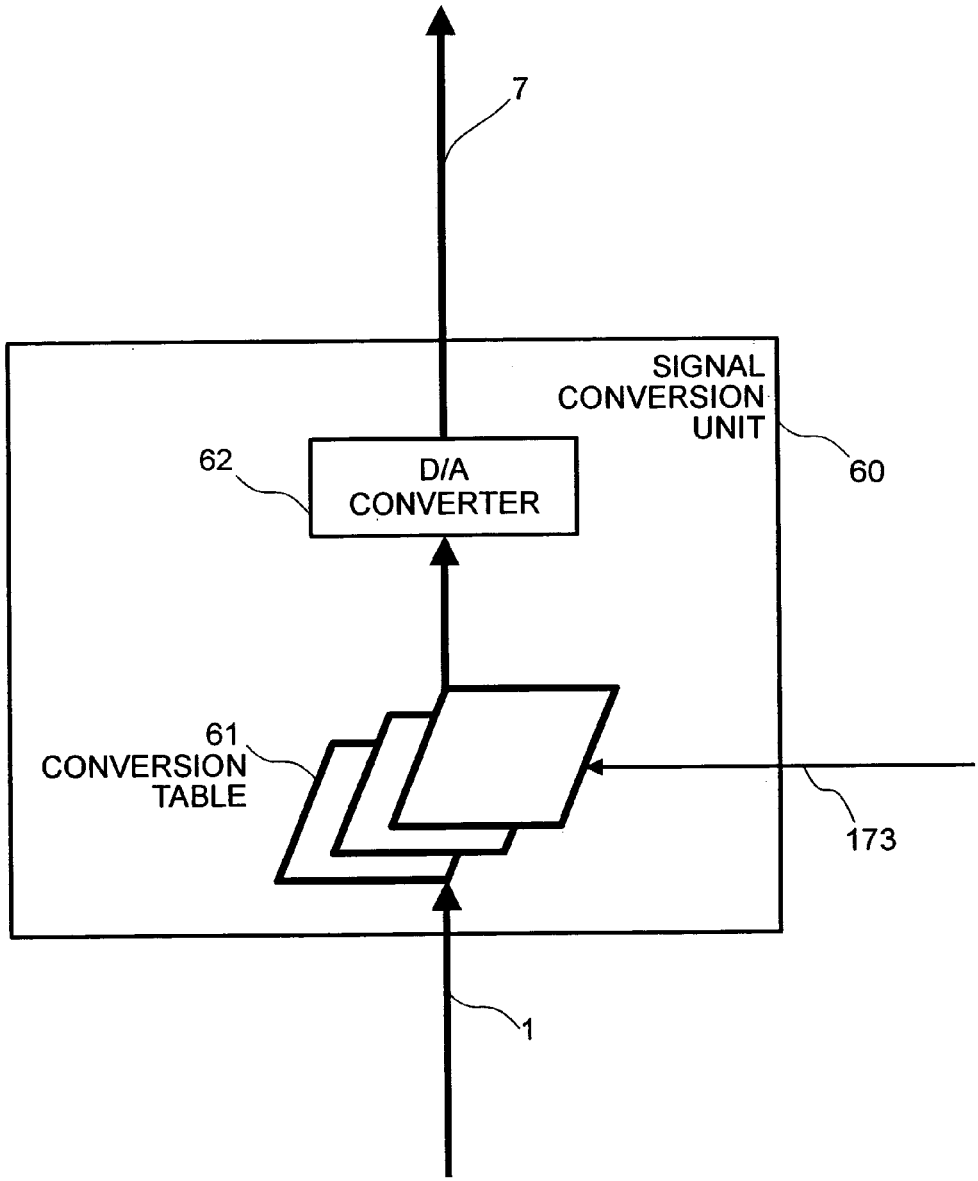
FIG. 13 shows only the portion of the configuration of the signal conversion unit 60 shown in FIG. 12 which is related to the display data signals.

FIG. 13 shows how the signal conversion unit 60 converts the input digital display data signal 1 into the analog display data signal 7 and outputs the analog signal. In the figure, the other signals handled by the signal conversion unit 60 are omitted since they are the same as those for the display control unit 6 of the first embodiment of the present invention described above. Reference numeral 61 denotes a conversion table, 62 denotes a D/A converter, and 173 denotes the average luminance information on the display unit 14. According to the third embodiment of the present invention, a plurality of conversion tables 61 are provided in the signal processing section of the signal conversion unit 60, as shown in FIG. 11. With this arrangement, the signal conversion unit 60 performs the steps of: selecting an optimum table from the conversion tables 61 according to the value of the average luminance information 173 on the display unit 14 obtained as a result of measuring the current flowing into the cathode potential control circuit 17; converting the digital display data signal 1 through digital signal processing based on the selected table; further converting the converted data (signal) into an analog voltage signal by use of its D/A converter; and outputting the converted analog voltage signal as the analog display data signal 7. The above configuration of the signal conversion unit 60 allows controlling the display luminance according to the average luminance information.

A fourth embodiment of the present invention will be described.

The fourth embodiment of the present invention sets up one or a plurality of light-emitting elements outside the screen. With this arrangement, the fourth embodiment detects the current in the elements flowing according to the luminance of light emitted from them and controls the display luminance of the display screen based on the amount of this current. The present embodiment can compensate for changes in the luminance of light emitted from the light-emitting elements due to temperature changes, making it possible to prevent an excessive rise in the luminance of emitted light and thereby reduce degradation of the light-emitting elements.

Figure 14:
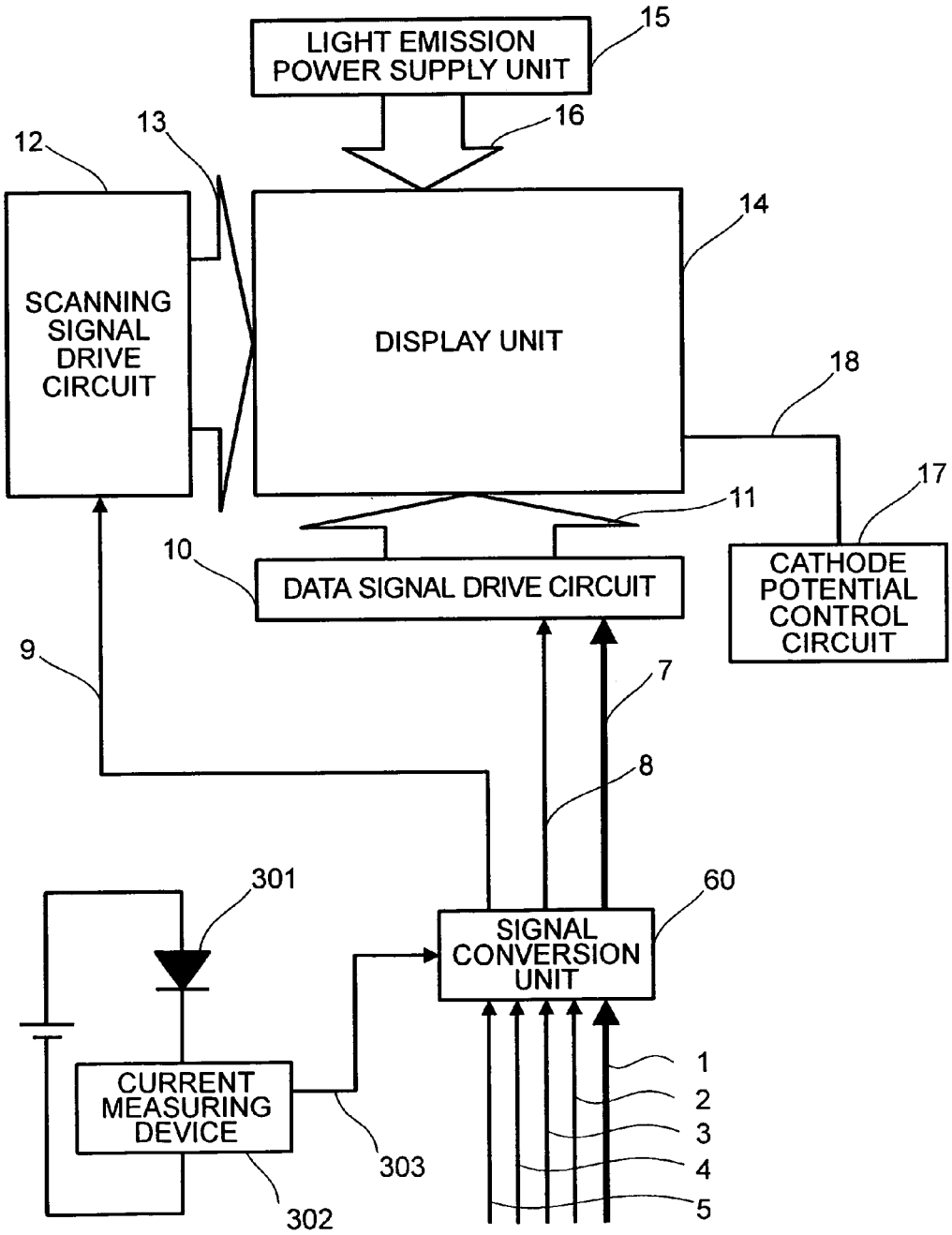
FIG. 14 shows an organic EL element display apparatus according to a fourth embodiment of the present invention.

In FIG. 14, reference numeral 301 denotes an organic EL element outside the screen (a separate organic EL element), 302 denotes a current measuring device, and 303 denotes temperature information.

This arrangement is made to reduce changes in the display luminance due to temperature changes as well as delaying degradation of the light-emitting elements due to an excessive increase in the display luminance. As shown in FIG. 14, one or a plurality of separate organic EL elements 301 are installed outside but near the display unit 14, and the current measuring device 302 measures the amount of current flowing in the elements when a constant voltage is applied to them. This allows estimating the temperature of the display unit 14. In FIG. 14, the display luminance control means of the third embodiment is used to control the display luminance of the display unit 14 based on this temperature information (303). However, it may be arranged that the display luminance control means of the first or second embodiment is employed to control the display luminance of the display unit 14.

A fifth embodiment of the present invention will be described in detail with accompanying drawings.

The fifth embodiment of the present invention is applied to display apparatuses as disclosed in JA-A-2000-235370 which accomplish a gray scale display using a pulse width modulation (PWM) signal according to an input signal for each pixel. A method according to the fifth embodiment of the present invention performs gray scale display operation using a pulse width modulation system, in which a gray scale display is accomplished by controlling the light-emitting elements by use of two values indicating whether or not to emit light and thereby controlling the length of the light emission time period or non-light-emission time period within each frame period. The present embodiment can be applied to pulse width modulation systems in which each pixel continuously emits light for a predetermined period of time during each frame period. In such pulse width modulation systems, there is a period(s) within each frame period during which only bright pixels emit light. The voltage applied between both electrodes of the light-emitting elements may be increased during this period to increase the peak luminance of only the bright pixels, making it possible to enhance the contrast and the image quality. Furthermore, since the above arrangement applies an ordinary voltage between both terminals of the light-emitting elements while the dark pixels are also emitting light, it is possible to increase the peak luminance of the pixels without causing a black display to be tinged with white (that is, it looks completely black).

Figure 15:
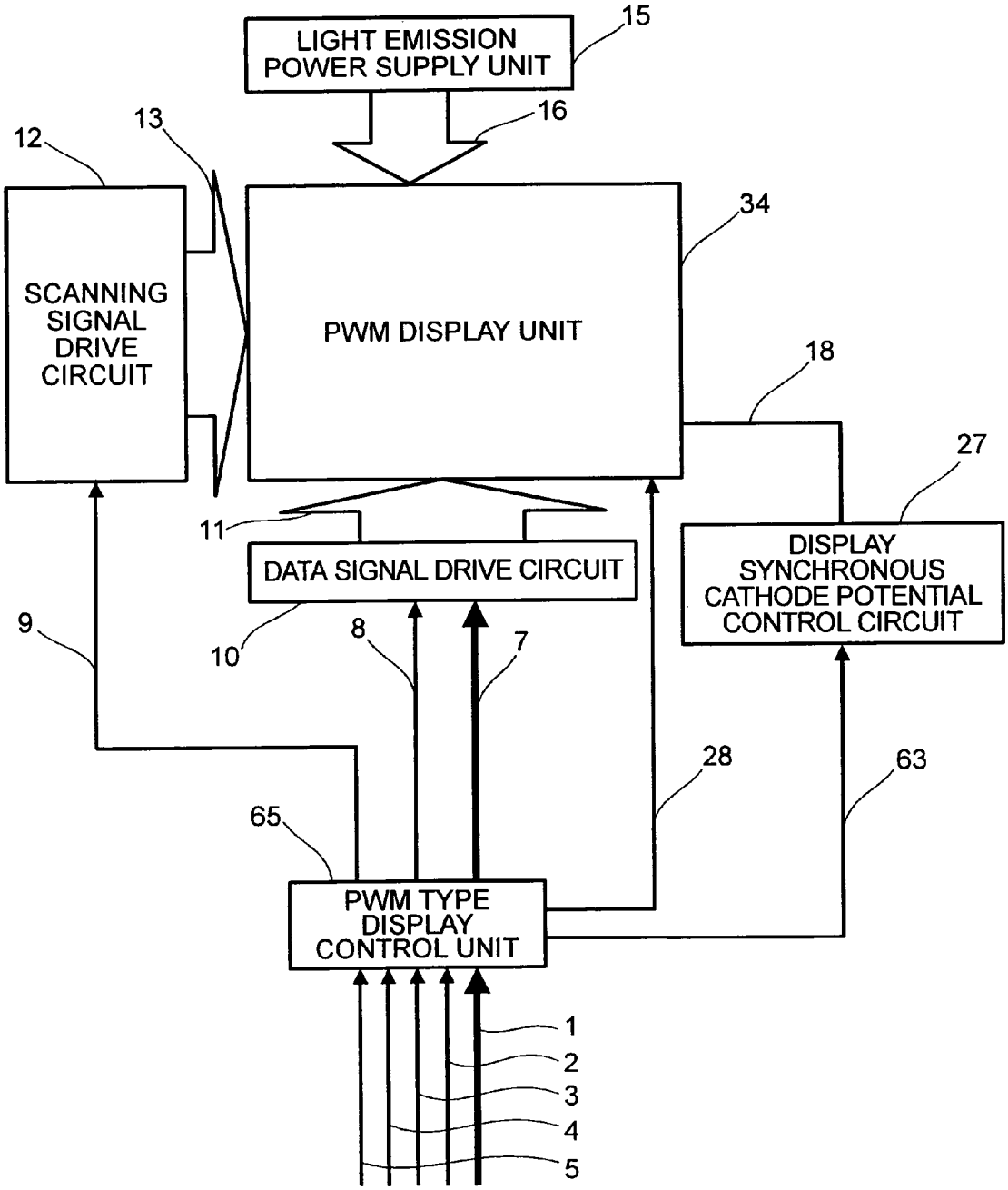
FIG. 15 shows a configuration example of an organic EL element display apparatus according to a fifth embodiment of the present invention.

FIG. 15 shows an organic EL element display apparatus according to the fifth embodiment of the present invention. Reference numerals which are the same as those used in FIG. 1 denote components or features common to the first and fifth embodiments.

In the figure, reference numeral 63 denotes a display phase signal, and 28 denotes a PWM control signal. A PWM type display control unit 65, newly employed by the present embodiment, converts the digital display data signal 1 into an analog signal having a predetermined voltage level and outputs it as the analog display data signal 7, as in the first embodiment. The PWM type display control unit 65 also outputs the data signal drive circuit control signal 8 and the scanning signal drive circuit control signal 9 at a predetermined timing according to the signals 1 to 5 entered from outside, as in the first embodiment. Further, the PWM type display control unit 65 also outputs the display phase signal 63 which is a control signal for controlling a display synchronous cathode potential control circuit 27. The display phase signal 63 has a period of one frame. Still further, the PWM type display control unit 65 outputs the PWM control signal 28 for controlling the PWM circuit of each pixel circuit in a PWM display unit 34. Even though the present embodiment newly employs the PWM display unit 34 as its display unit, the operations of the data signal drive circuit 10 and the scanning signal drive circuit 12 are the same as those for the first embodiment. The data signal drive circuit 10 is controlled with the data signal drive circuit control signal 8 and writes the display data signal to the PWM display unit 34 through the datalines 11. The scanning signal drive circuit 12 is controlled with the scanning signal drive circuit control signal 9 and sends a write selection signal to the PWM display unit 34 through the scanlines 13. The light emission power supply unit 15 supplies to the PWM display unit 34 through the light emission power supply lines 16 the power necessary for the organic EL elements to emit light. Reference numeral 27 denotes the display synchronous cathode potential control circuit 27. The display synchronous cathode potential control circuit 27 controls the cathode side potential of the organic EL elements within the PWM display unit 34 according to the display phase signal 63. The PWM display unit 34 varies the light emission time period of the organic EL element of each pixel within the unit for each frame period according to the display data written by the data signal drive circuit 10 so as to display a gray scale image. One frame period refers to a period during which one screen of data is input to the display apparatus. It should be noted that a plurality of subfield scanning operations may be carried out during a single frame period.

Figure 16:
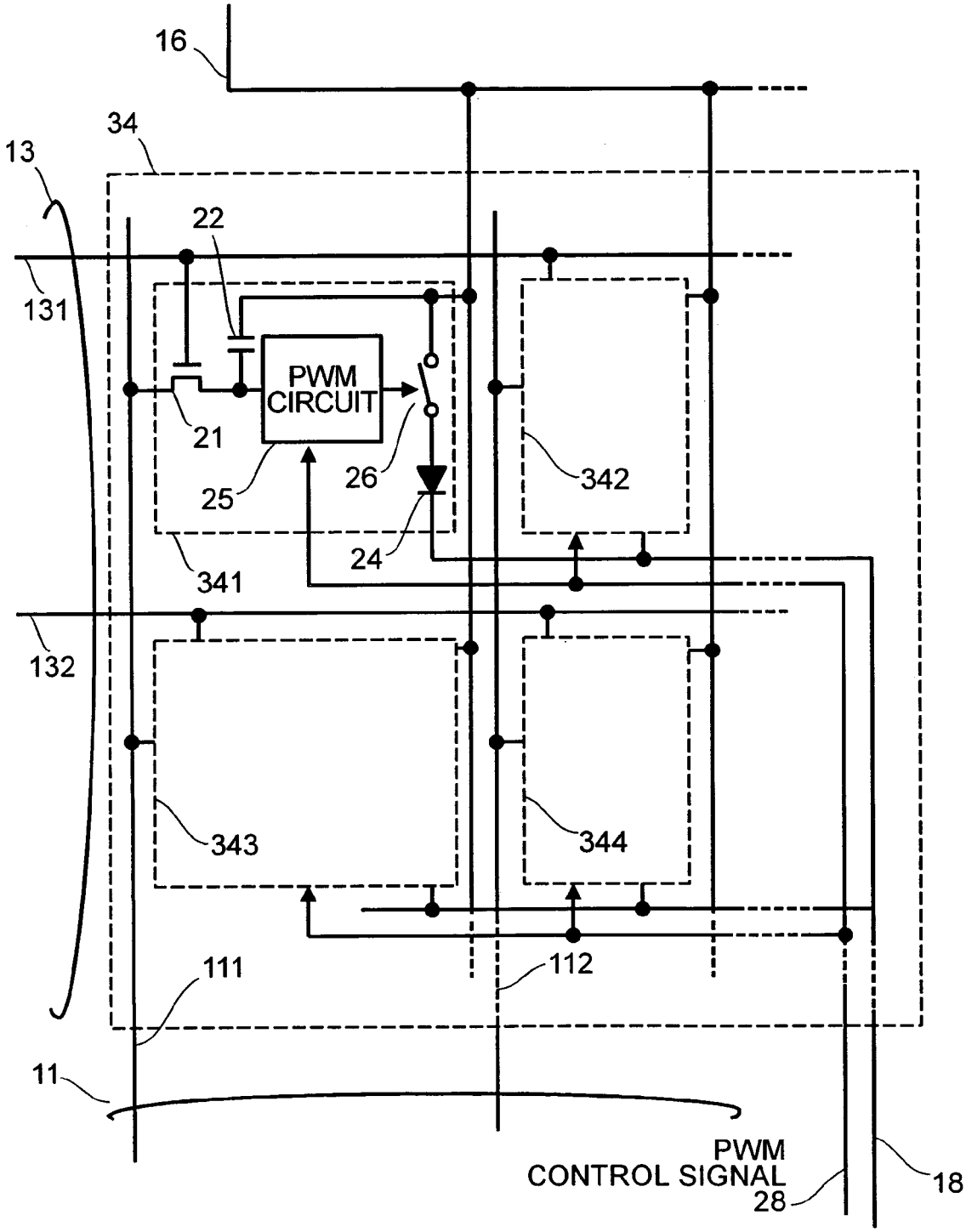
FIG. 16 shows the internal configuration of the PWM display unit 34 shown in FIG. 15.

FIG. 16 shows the internal configuration of the PWM display unit 34. The following description explains a first-row first-column pixel 341. FIG. 16 only shows the internal configuration of the first-row first-column pixel 341. However, a first-row second-column pixel 342, a second-row first-column pixel 343, and a second-row second-column pixel 344 also have the same configuration. Reference numeral 25 denotes a PWM circuit, and 26 denotes a light emission switch. The present embodiment controls the display luminance of each organic EL element 24 by changing the ratio of the light emission time period to the non-light-emission time period within each frame period through on/off control of the voltage applied to the organic EL element 24. Upon receiving a light emission start pulse of the PWM control signal 28, the PWM circuit 25 turns on the light emission switch 26, applying a predetermined voltage to the organic EL element 24 to start light emission. The PWM circuit 25 then counts each pulse of the PWM control signal 28 and turns off the light emission switch 26 at a predetermined timing according to the voltage stored on the data storage capacitance 22, interrupting application of the voltage to the organic EL element 24 so as to stop the element from emitting light.

Thus, the configurations shown in FIGS. 15 and 16 allow controlling the light emission time period of each organic EL element 24, making it possible to set a gray scale level for each pixel. It should be noted, however, that the configurations shown in FIGS. 15 and 16 for implementing a gray scale display method using a PWM system is provided by way of example only. The present embodiment is not limited to the above arrangement in which a counter is provided in each pixel circuit as a means for performing PWM control. Furthermore, the PWM control signal 28 may have a waveform other than clock signal waveforms.

Figure 17:
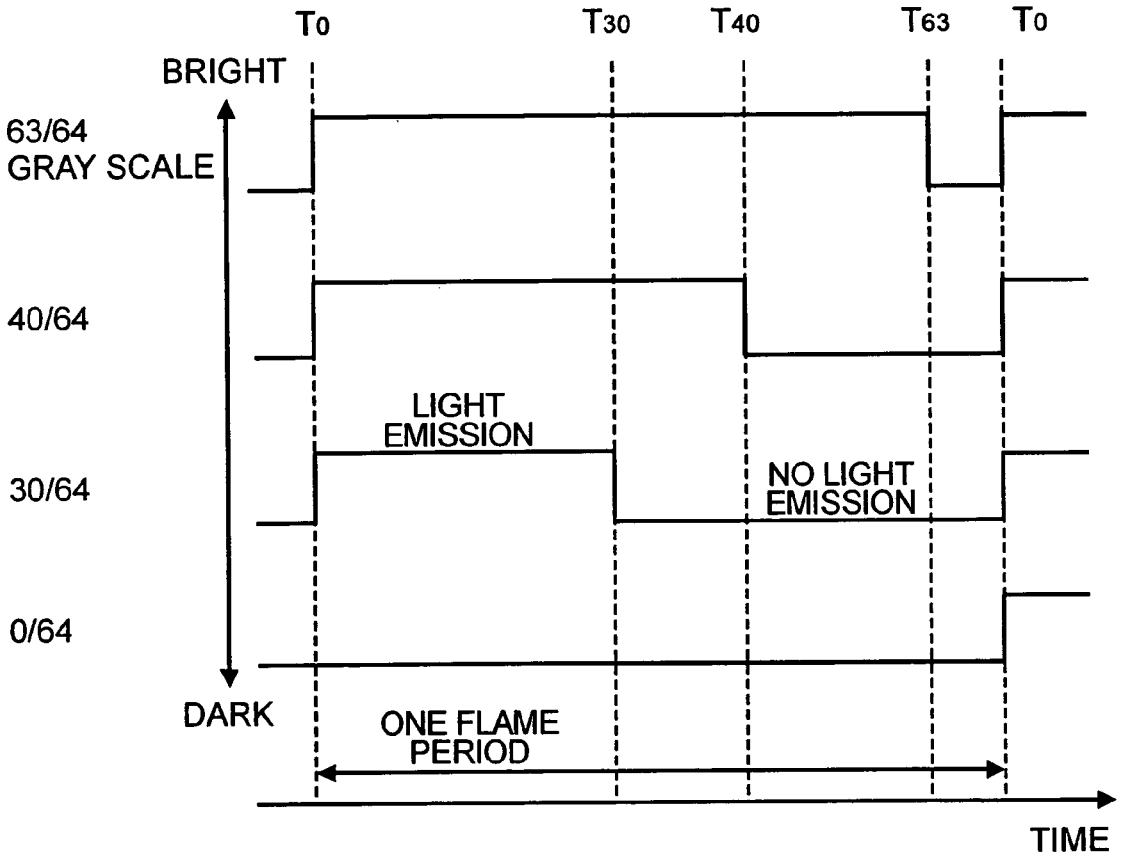
FIG. 17 is a diagram conceptually showing a pulse width modulation drive system.

FIG. 17 conceptually shows a pulse width modulation system according to the present embodiment. Assume, for example, that 64 gray scale levels, from gray scale number 0 to gray scale number 63, are to be displayed. In FIG. 17, all pixels other than the pixel whose light emission time period is 0 (that is, whose gray scale number is 0) begin to emit light at time T0. Then, as time elapses, the pixels sequentially stop emitting light in the order of increasing gray scale number (the pixel whose gray scale number is 63 is the last to stop emitting light). It should be noted that the above arrangement is by way of example. It may be arranged that all pixels have stopped emitting light at time T0, and then the pixels sequentially begin to emit light in the order of decreasing gray scale number. As described above, the present embodiment controls the light emission time period according to the gray scale level to provide a gray scale display.

FIG. 18 shows the relationship between the analog voltage input to the PWM circuit 25 through the data signal line and the light emission time period of the organic EL element 24. The figure indicates that the light emission time period within each frame period increases with increasing signal voltage level (that is, increasing gray scale number).

Figure 19:
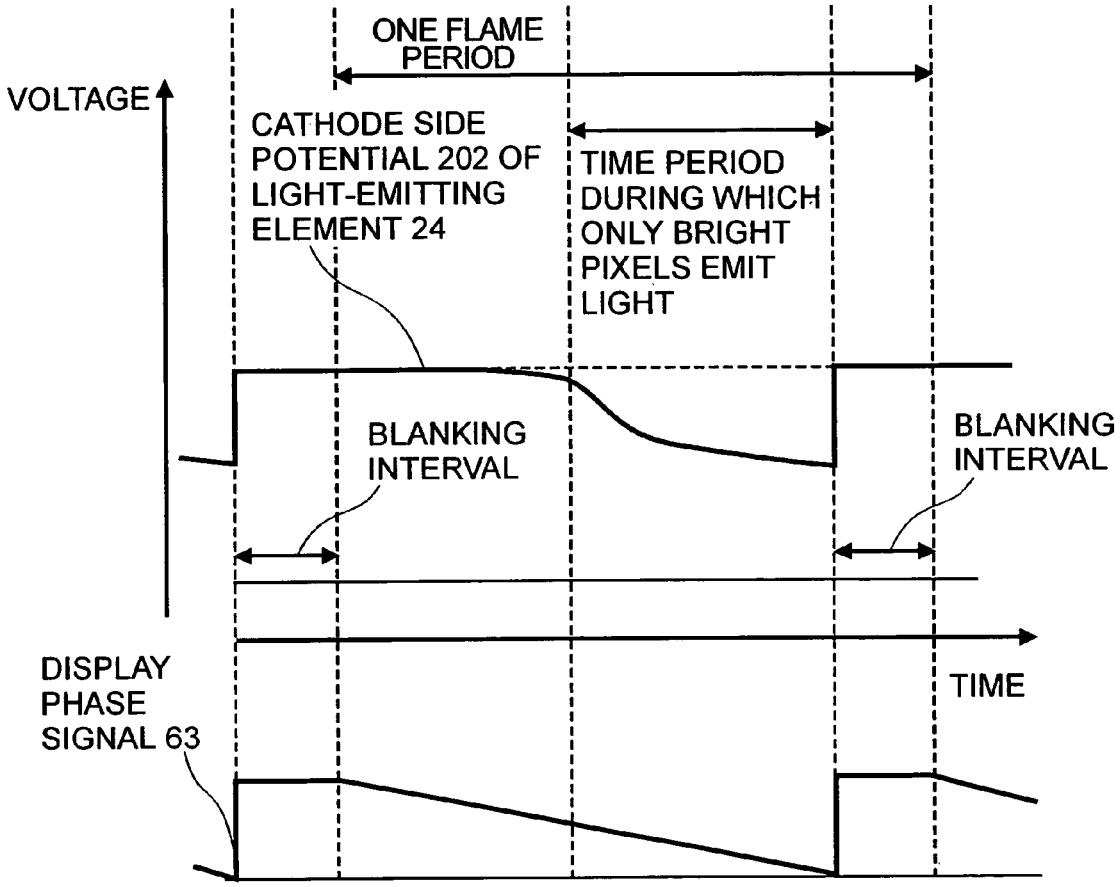
FIG. 19 conceptually shows how the display synchronous cathode potential control circuit with average luminance monitoring capability 27 shown in FIG. 15 controls the output voltage.

FIG. 19 shows an example of how the display synchronous cathode potential control circuit 27 controls the output voltage. The display phase signal 63 has a period of one frame and indicates the period of each frame. FIG. 19 indicates the display phase signal 63 as a sawtooth waveform signal. However, the display phase signal 63 may be a digital signal having one or a plurality of bits, or it may be an analog signal. Further, FIG. 19 indicates a blanking interval during which all pixels (from those with the lowest gray scale value to those with the highest gray scale value) emit no light. However, this interval may not be employed. The display synchronous cathode potential control circuit 27 reduces the cathode side potential of the organic EL elements 24 and thereby increases the voltage between both electrodes of each organic EL element 24 according to the display phase signal 63 only while the pixels with small gray scale numbers are emitting no light and the pixels with large gray scale numbers are emitting light. This control allows only the pixels with high gray scale values to be caused to emit light at a high luminance level, enhancing the peak luminance and thereby enhancing the visual impact of the display screen. Further, the display synchronous cathode potential circuit 27 does not apply any high voltage to the organic EL elements 24 while the pixels with low gray scale values are emitting light, making it possible to prevent a black display from becoming tinged with white and enhance the contrast. Still further, the present embodiment applies a high voltage to only bright pixels and applies a low voltage to the other pixels, reducing the overall voltage stress on the organic EL elements while maintaining a comparatively high peak luminance level. Therefore, the present embodiment is effective in reducing degradation of the organic EL elements.

A sixth embodiment of the present invention will be described in detail with reference to accompanying drawings. The sixth embodiment of the present invention is also applied to display apparatuses which accomplish a gray scale display using a pulse width modulation signal according to an input signal for each pixel. In a pulse width modulation system, the sixth embodiment of the present invention detects an average luminance level of the display screen and stops peak luminance enhancement control when an image having a high average luminance level is currently displayed since increasing the peak luminance does not lead to enhancement of the display quality. This makes it possible to prevent unnecessary power consumption and reduce degradation of the light-emitting elements as well as enhancing the display quality.

Figure 20:
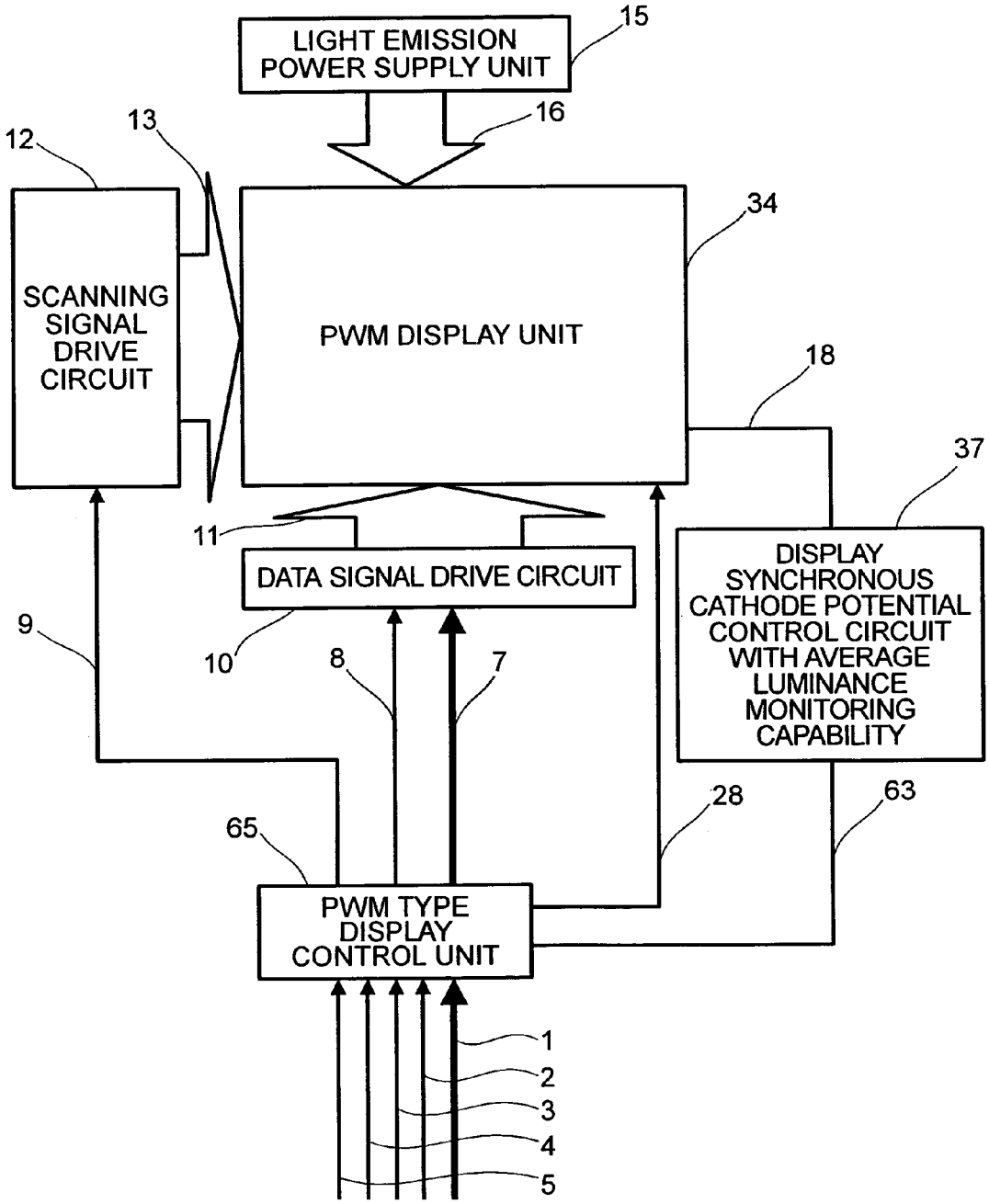
FIG. 20 shows a configuration example of an organic EL element display apparatus according to a sixth embodiment of the present invention.

FIG. 20 shows an organic EL element display apparatus according to the sixth embodiment of the present invention. Reference numerals which are the same as those used in FIG. 1 denote components or features common to the first and sixth embodiments.

In the figure, reference numeral 37 denotes a display synchronous cathode potential control circuit with average luminance monitoring capability. The display synchronous cathode potential control circuit with average luminance monitoring capability 37, newly employed by the sixth embodiment, controls the cathode side potential of the organic EL elements 24 within the PWM display unit 34 according to the display phase signal 63 and an average luminance level of the PWM display unit 34. The PWM display unit 34 varies the light emission time period (or non-light-emission time period) of the organic EL element of each pixel within the unit for each frame period according to the display data written by the data signal drive circuit 10 so as to display a gray scale image.

Figure 21:
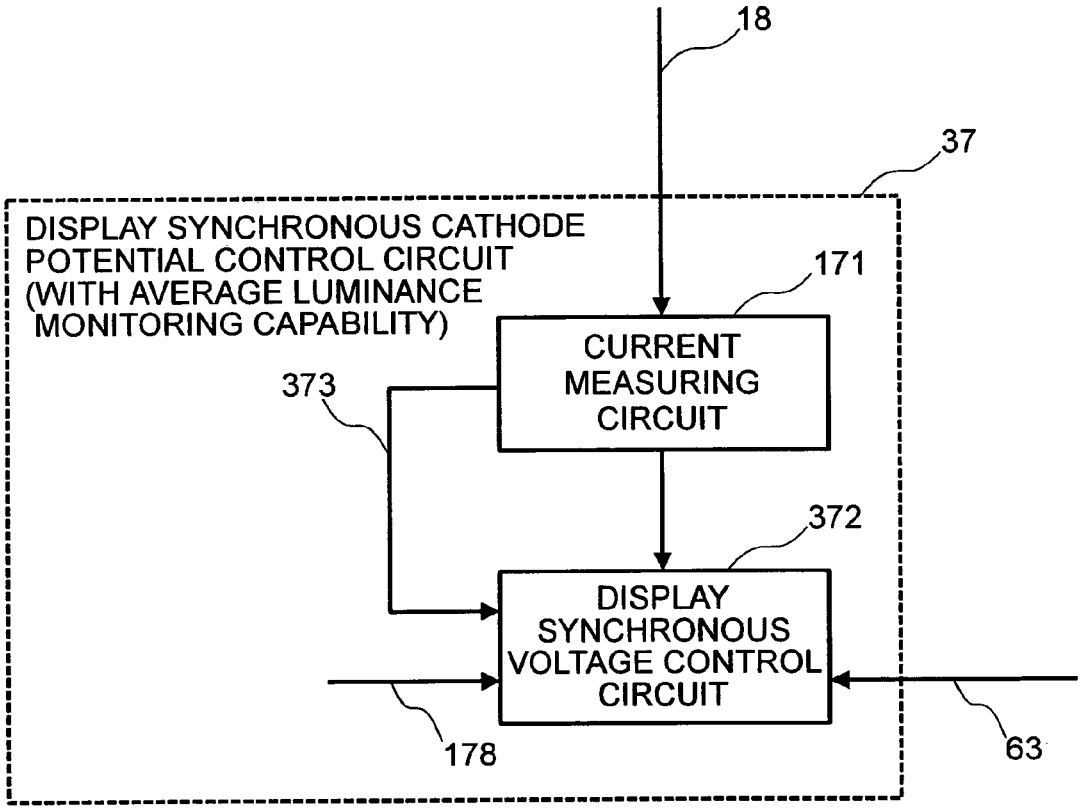
FIG. 21 shows the configuration of the display synchronous cathode potential control circuit with average luminance monitoring capability 37 shown in FIG. 20.

FIG. 21 shows the configuration of the display synchronous cathode potential control circuit with average luminance monitoring capability 37. Reference numeral 171 denotes a current measuring circuit, and 373 denotes average luminance information on the PWM display unit.

The current which has contributed to the light emission of each pixel of the PWM display unit 34 flows into the current measuring circuit 171 through the cathode current line 18. The current measuring circuit 171 measures this current, as in the first embodiment. When the display unit is driven by a pulse width modulation (PWM) system, however, the value of the current flowing in the cathode current line 18 exhibits rapid and large changes during each frame period (since a large current flows when all pixels of the PWM display unit 34 emit light and a small or no current flows when none of them emits light). Therefore, a low-pass filter, etc. may be provided within the current measuring circuit 171 to average the measured current values (smooth the current) so as to obtain an average luminance level of the PWM display unit 34. The average luminance information 373 on the PWM display unit is represented by a signal converted from the measured average luminance value obtained as described above.

Reference numeral 372 denotes a display synchronous voltage control circuit. The display synchronous voltage control circuit 372 controls the output voltage according to the average luminance information 373 on the PWM display unit 34 and the display phase signal 63.

Figure 22:
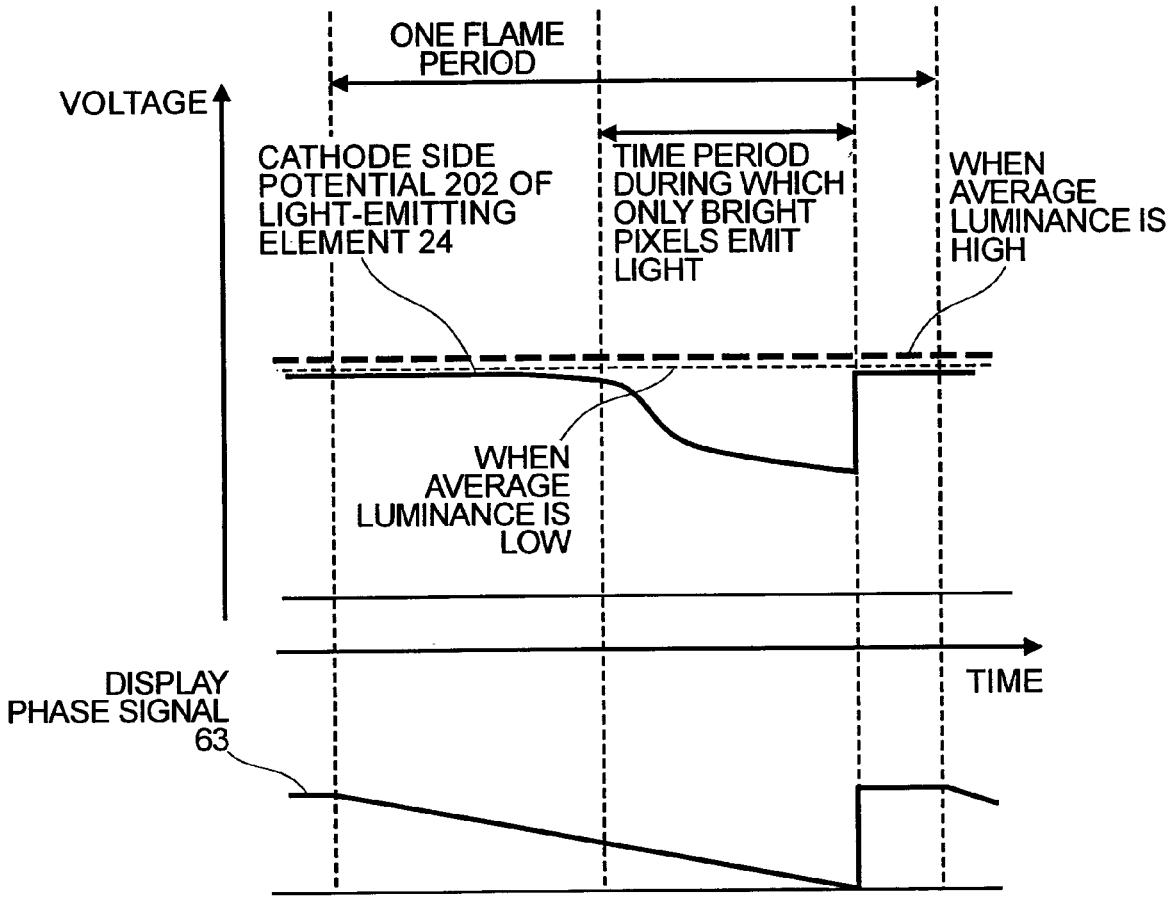
FIG. 22 conceptually shows how the display synchronous cathode potential control circuit with average luminance monitoring capability 37 shown in FIG. 20 controls the output voltage.

FIG. 22 shows an example of how the display synchronous cathode potential control circuit with average luminance monitoring capability 37 controls the output voltage. The display synchronous cathode potential control circuit with average luminance monitoring capability 37 reduces the cathode side potential of the organic EL elements 24 and thereby increases the voltage between both electrodes of each organic EL element 24 according to the display phase signal only while the pixels with small gray scale numbers are emitting no light and the pixels with large gray scale numbers are emitting light. This control allows only the pixels with high gray scale values to be caused to emit light at a high luminance level, increasing the peak luminance and thereby enhancing the visual impact of the display screen. Further, the display synchronous cathode potential control circuit with average luminance monitoring capability 37 does not apply any high voltage to the organic EL elements 24 while the pixels with low gray scale values are also emitting light, making it possible to prevent a black display from becoming tinged with white and enhance the contrast. Whether a gray scale level indicated by image data is high or low is determined by checking whether the level is larger or smaller than a predetermined middle gray scale level (between the highest and lowest gray scale levels).

However, when an image consisting mostly of bright pixels (that is, having a high average luminance level) is displayed on the screen, increasing the peak luminance does not lead to enhancement of the display quality. Therefore, when an image having a high luminance level is displayed, the display synchronous cathode potential control circuit with average luminance monitoring capability 37 stops the above voltage boosting control operation on the voltage applied to the organic EL elements 24. The average luminance level is measured by the current measuring circuit 171, as described above.

Controlling the voltage applied to the organic EL elements allows enhancing the image quality while reducing the power consumption and degradation of the light-emitting elements, as exemplified by the sixth embodiment. Furthermore, it is possible to estimate changes in the luminance of emitted light due to temperature changes and the degree of degradation of the organic EL elements by measuring an average luminance level of the display. Therefore, it may be arranged that the luminance changes and the degradation of the organic EL elements are compensated for.

It should be noted that the waveform of the voltage applied to the organic EL elements 24 is not limited to that shown in FIG. 22. Any waveform may be used within the spirit and the scope of the present invention. Further, according to the present embodiment, the average luminance detecting means and the means for controlling the voltage applied to the organic EL elements 24 are provided on the cathode side of the organic EL elements 24. However, they may be provided on the anode side.

Figure 23:
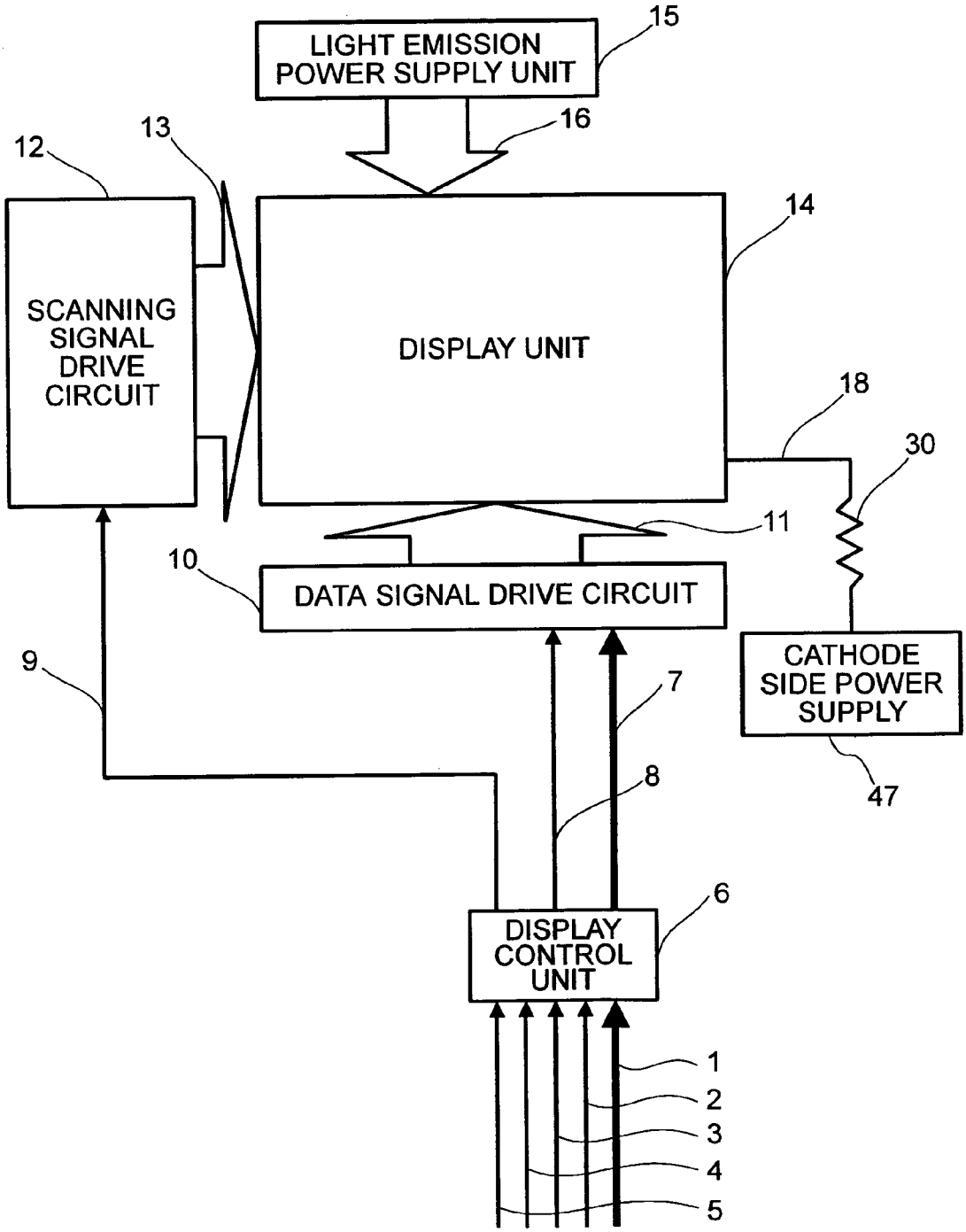
FIG. 23 shows a configuration example of an organic EL element display apparatus according to a seventh embodiment of the present invention.

A seventh embodiment of the present invention will be described. FIG. 23 shows a configuration example of an organic EL element display apparatus according to the seventh embodiment of the present invention. Based on the fact that a current proportional to the average luminance level of the display screen flows through the supply line of the light emission power to the light-emitting elements, the seventh embodiment of the present invention inserts a resistance in this power supply line to produce a voltage drop across the resistance which is proportional to the average luminance level of the display unit. This simple configuration can be used to control the display luminance such that it is reduced when the average luminance level of the display unit is high.

In FIG. 23, reference numeral 47 denotes a cathode power supply unit, and 30 denotes a luminance adjustment resistance.

The cathode power supply unit 47 is provided on the cathode side of the organic EL elements 24 and outputs a constant voltage. The luminance adjustment resistance 30 is inserted in the cathode current line 18, that is, provided between the display unit 14 and the cathode side power supply 47, outside the display unit 14.

On the anode side of the organic EL elements 24, power is supplied from the light emission power supply unit 15 to the organic EL element of each pixel within the display unit 14 through the light emission power supply lines 16. On the cathode side of the organic EL elements 24, on the other hand, power is supplied from the cathode side power supply 47 to the organic EL element of each pixel through the cathode current line 18 and the luminance adjustment resistance 30.

As described in connection with the first embodiment, when the display unit 14 emits light, a current proportional to the average luminance level of the display unit 14 flows through the cathode current line 18. Due to this current, a voltage is generated across the luminance adjustment resistance 30. The generated voltage is proportional to the value of current flowing in the cathode current line 18. Therefore, the cathode side potential of the organic EL elements 24 varies according to the current flowing in the cathode current line 18. Specifically, the larger the current flowing through the cathode current line, the higher the cathode side potential of the organic EL elements 24 and the lower the voltage applied to both electrodes of each organic EL element 24. Accordingly, the present embodiment can perform control so as to reduce the display luminance when an image having a high average luminance level is displayed, and increase the peak display luminance when an image having a low average luminance level is displayed. With this arrangement, it is possible to reduce degradation of the light-emitting elements.

Thus, the seventh embodiment of the present invention has a simple configuration in which the luminance adjustment resistance 30 is inserted on the cathode side of the organic EL elements 24, which makes it possible to control the display luminance according to the average luminance level. It should be noted that the luminance adjustment resistance 30 may be inserted in the light emission power supply lines 16 on the anode side of the organic EL elements 24.

Figure 24:
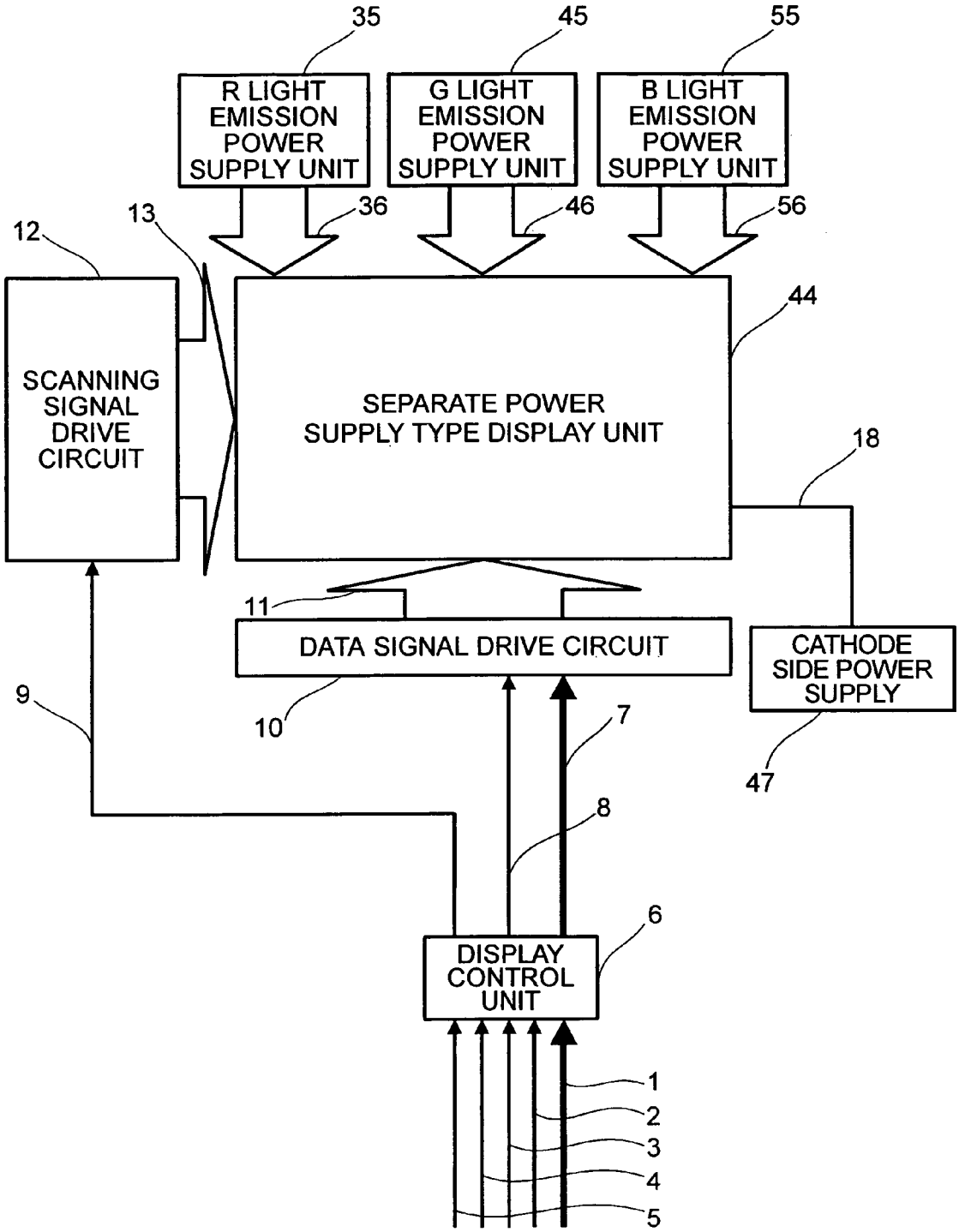
FIG. 24 shows a configuration example of an organic EL element display apparatus according to an eighth embodiment of the present invention.

A eighth embodiment of the present invention will be described. FIG. 24 shows a configuration example of an organic EL element display apparatus according to the eighth embodiment of the present invention. The eighth embodiment of the present invention sets up light emission power supply lines for each color (R, G, B) separately, monitors the current contributing to the light emission of each color to obtain a respective average luminance level, and controls the luminance of emitted light of each color according to the respective average luminance level. This arrangement allows correcting degradation rate variations among the colors.

Reference numeral 35 denotes an R light emission power supply unit; 36, R light emission power supply lines; 44, a separate power supply type display unit; 45, a G light emission power supply unit; 46, G light emission power supply lines; 55, a B light emission power supply unit; and 56, B light emission power supply lines.

The eighth embodiment sets up a light emission power supply unit for each color (R, G, B). The R light emission power supply unit 35 is a light emission power supply dedicated for R pixels, and the R light emission power supply lines 36 are power supply lines dedicated for R pixels. The G light emission power supply unit 45 and the B light emission power supply unit 55 work for G color and B color, respectively, in the same way as the R light emission power supply unit 35 does for R color. Likewise, the G light emission power supply lines 46 and the B light emission power supply lines 56 work for G color and B color, respectively, in the same way as the R light emission power supply lines 36 do for R color. It should be noted that the R light emission power supply unit 35, the G light emission power supply unit 45, and the B light emission power supply unit 55 each include an average luminance level measuring means and a display luminance control means for their respective colors (R, G, and B). Each average luminance level measuring means obtains an average luminance level by measuring the current in the light emission power supply lines for a respective color (R, G, or B), while each display luminance control means controls the display luminance for a respective color by controlling an output voltage. Further, reference numeral 44 denotes a separate power supply type display unit having a structure in which the R, G, and B light emission power supply lines are separated from one another.

The data signal drive circuit 10 is controlled with the data signal drive circuit control signal 8 and writes the display data signal to the separate power supply type display unit 44 through the datalines. The scanning signal drive circuit 12 is controlled with the scanning signal drive circuit control signal 9 and sends a write selection signal to the separate power supply type display unit 44 through the scanlines 13. Thus, the display data signal is written to each pixel within the display unit 44 selected by the scanning signal drive circuit 12 so as to provide a gray scale display.

Power for the organic EL element of each pixel within the separate power supply type display unit 44 is supplied as follows. On the anode side of the organic EL elements 24 having R color, the R light emission power supply unit 35 supplies power to the elements through the R light emission power supply lines 36. On the anode side of the organic EL elements 24 having G color, the G light emission power supply unit 45 supplies power to the elements through the G light emission power supply lines 46. On the anode side of the organic EL elements 24 having B color, the B light emission power supply unit 55 supplies power to the elements through the B light emission power supply lines 56. On the cathode side of the organic EL elements 24, the cathode side power supply 47 supplies power to the elements through the cathode current line 18.

Figure 25:
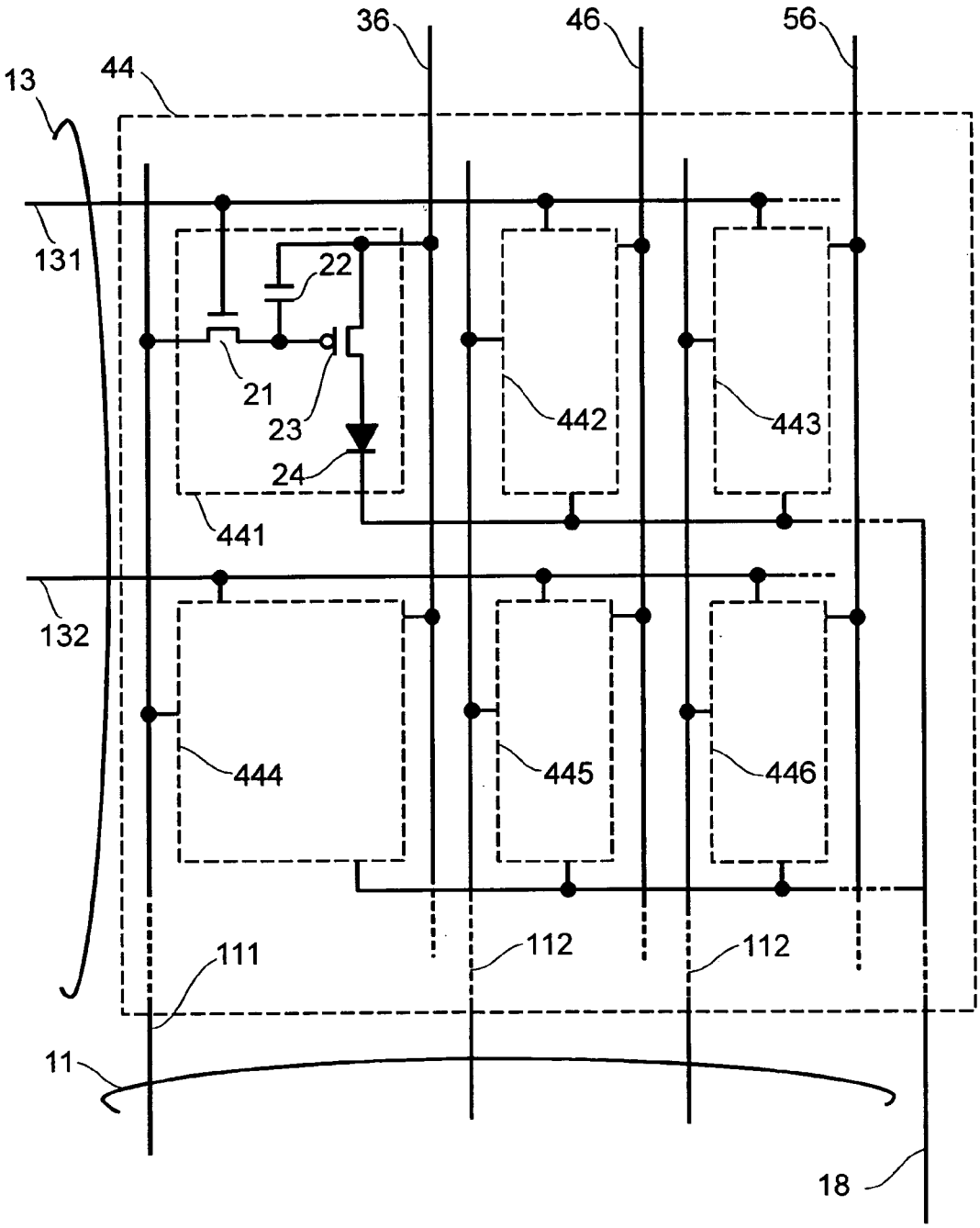
FIG. 25 shows an internal configuration example of a separate power supply type display unit.

FIG. 25 shows an internal configuration example of the separate power supply type display unit 44. Reference numerals 441 and 444 denote R pixel circuits, 442 and 445 denote G pixel circuits, and 443 and 446 denote B pixel circuits. Each R pixel circuit is connected to an R light emission power supply line 36, each G pixel circuit is connected to a G light emission power supply line 46, and each B pixel circuit is connected to a B light emission power supply line 56.

Description will be made of the operation of the display apparatus of the eighth embodiment. The R light emission power supply unit 35, the G light emission power supply unit 45, and the B light emission power supply unit 55 each independently control display luminance according to an average luminance level as in the first embodiment.

The material characteristics and the degradation characteristics of each organic EL element vary depending on its color, which causes color balance mismatches. Assume, for example, that one of the three colors has degraded more than the others since it degrades faster than them. The more degraded color (pixels) exhibits a lower average luminance level than the less degraded colors (pixels). In such a case, the light emission power supply unit for the more degraded color (pixels) functions so as to increase the display luminance (of the more degraded pixels) since the average luminance level is low. The light emission power supply units for the less degraded colors (pixels), on the other hand, function so as to decrease the display luminance of the less degraded pixels since the average luminance levels are high. Thus, setting up the average luminance detecting means and the display luminance control means makes it possible to compensate for color balance mismatches due to degradation of the elements. Naturally, the present embodiment also can reduce degradation of the light-emitting elements while maintaining the peak luminance.

The eighth embodiment described above includes average luminance detecting means which measure the values of the currents flowing in the light emission power supply lines. However, the present invention is not limited to this particular type of average luminance detecting means. Any type of average luminance detecting means can be used if the average luminance level of each color can be measured separately and the luminous intensity of each color can be controlled separately. Further, the eighth embodiment described above includes display luminance control means which control the voltages supplied to the light emission power supply lines. However, the present invention is not limited to this particular type of display luminance control means. Any type of display luminance control means can be used if the average luminance level of each color can be measured separately and the luminous intensity of each color can be controlled separately. Still further, the control of the luminance of emitted light for each color (R, G, B) employed by the eighth embodiment may be applied to the sixth embodiment.

The above 8 embodiments are described as applied to the organic EL element selected from among all available light-emitting elements. However, the present invention is not limited to this particular type of light-emitting element (the organic EL element). Other types of light-emitting elements may be employed. It should be noted that two or more of the above 8 embodiments may be combined to serve a specific purpose.

The effects of the invention disclosed in this application will be briefly described as follows.

A light-emitting element display apparatus of the present invention measures an average of display luminance levels of the screen and reduces the display luminance level for the subsequent video signal input to the display apparatus when the measured average level is high, making it possible to extend the life of the organic EL elements while maintaining the display quality and reduce changes in the display luminance due to temperature changes.

Another light-emitting element display apparatus of the present invention employs light emission power supply lines for each color (R, G, B) separately and performs the above (display luminance level) control (for each color), making it possible to correct degradation rate variations among the colors and prevent occurrence of a color balance mismatch.

Still another light-emitting element display apparatus of the present invention, which provides a gray scale display by use of a pulse width modulation system, increases the voltage applied to the light-emitting elements only while the bright pixels are emitting light, making it possible to increase the peak luminance of the white display portion while reducing a rise in the luminance of the black display portion.

What is claimed is:

1. A display apparatus comprising:

a pixel array including a plurality of pixels, each pixel including:

a light emitting unit, a drive element for controlling supply of a current to said light emitting unit, and a switching element for controlling said drive element according to an image signal;

a data signal drive circuit for receiving image data for each frame period and outputting said image signal to said pixel array based on said image data, said each frame period being provided for displaying one screen of said image data;

a scanning signal drive circuit for outputting a scanning signal to said pixel array, said scanning signal being for controlling a timing at which said switching element receives said image signal;

a current source for, through said drive element, outputting said current supplied to said light emitting unit; and a control circuit for increasing a light emission time period within said each frame period with increasing gray scale number, and increasing a voltage applied to said light emitting unit continuously by reducing a cathode side potential of the light emitting unit continuously starting at an end of a light emission time period corresponding to a predetermined gray scale number within said each frame period, in order to increase peak luminance, wherein each frame period includes said light emission time period and a non-light emission time period after said light emission time period.

2. The display apparatus as claimed in claim 1, wherein:

said pixel array includes a pixel for red, a pixel for green, and a pixel for blue; and said current source is provided for each of said pixel for red, said pixel for green, and said pixel for blue, separately.

3. The display apparatus as claimed in claim 1, wherein said current source controls said value or said amount of said current according to a control signal input to said current source.

4. The display apparatus as claimed in claim 3, further comprising:

a PWM control circuit for generating a PWM control signal for, through said drive element, controlling whether or not said light emitting unit emits light, during said each frame period; and a voltage control circuit for, based on said PWM control signal, generating said control signal input to said current source.

5. The display apparatus as claimed in claim 3, further comprising:

a voltage control circuit for detecting said value or said amount of said current and, based on said value or said amount of said current, generating said control signal input to said current source.

6. The display apparatus as claimed in claim 5, wherein said voltage control circuit calculates a luminance level of said image data for said each frame period based on said value or said amount of said current and, based on said luminance level of said image data for said each frame period, generating said control signal input to said current source.

7. The display apparatus as claimed in claim 5, wherein said voltage control circuit calculates the degree of degradation of said light emitting unit based on said value or said amount of said current and, based on said degree of degradation of said light emitting unit, generating said control signal input to said current source.

8. The display apparatus as claimed in claim 5, wherein said voltage control circuit calculates temperature of said pixel array based on said value or said amount of said current and, based on said temperature of said pixel array, generating said control signal input to said current source.

9. The display apparatus as claimed in claim 3, further comprising:

another light emitting unit provided separately from said pixel array; and a voltage control circuit for detecting temperature of said another light emitting unit and, based on said temperature of said another light emitting unit, generating said control signal input to said current source.

10. A method for displaying an image based on image data by use of a pixel array including a plurality of pixels, each pixel including:

a light emitting unit;

a drive element for controlling supply of a current to said light emitting unit; and a switching element for controlling said drive element according to an image signal;

wherein said method comprises the steps of:

outputting said current from a current source to said light emitting unit through said drive element;

receiving said image data for each frame period and outputting said image signal from a data signal drive circuit to said pixel array based on said image data, said each frame period being provided for displaying one screen of said image data;

outputting a scanning signal from a scanning signal drive circuit to said pixel array, said scanning signal being for controlling a timing at which said switching element receives said image signal; increasing a light emission time period within said each frame period with increasing gray scale number, said each frame period including said light emission time period and a non-light emission time period after said light emission time period; and increasing a voltage applied to said light emitting unit continuously by reducing a cathode side potential of the light emitting unit continuously starting at an end of a light emission time period corresponding to a predetermined gray scale number within said each frame period, in order to increase peak luminance.

* * * * *